US010525758B2

(12) United States Patent
Fuhse et al.

(10) Patent No.: US 10,525,758 B2
(45) Date of Patent: Jan. 7, 2020

(54) SECURITY ELEMENT, VALUE DOCUMENT COMPRISING SUCH A SECURITY ELEMENT, AND METHOD FOR PRODUCING SUCH A SECURITY ELEMENT

(71) Applicant: Giesecke+Devrient Currency Technology GmbH, Munich (DE)

(72) Inventors: Christian Fuhse, Otterfing (DE); Michael Rahm, Bad Tolz (DE); Andreas Rauch, Ohlstadt (DE); Wittich Kaule, Emmering (DE)

(73) Assignee: GIESECKE+DEVRIENT CURRENCY TECHNOLOGY GMBH, Munich (DE)

( * ) Notice: Subject to any disclaimer, the term of this patent is extended or adjusted under 35 U.S.C. 154(b) by 0 days.

(21) Appl. No.: 15/706,195

(22) Filed: Sep. 15, 2017

(65) Prior Publication Data

US 2018/0001690 A1 Jan. 4, 2018

Related U.S. Application Data

(63) Continuation of application No. 13/513,690, filed as application No. PCT/EP2010/007368 on Dec. 3, 2010, now Pat. No. 9,827,802.

(30) Foreign Application Priority Data

Dec. 4, 2009 (DE) ..... 10 2009 056 934

(51) Int. Cl.
*B42D 25/328* (2014.01)
*B42D 25/324* (2014.01)
(Continued)

(52) U.S. Cl.
CPC ..... *B42D 15/00* (2013.01); *B42D 25/21* (2014.10); *B42D 25/23* (2014.10); *B42D 25/24* (2014.10);
(Continued)

(58) Field of Classification Search
CPC ..... B42D 2033/24; B42D 2035/28; B42D 25/324; B42D 25/328
See application file for complete search history.

(56) References Cited

U.S. PATENT DOCUMENTS 4,012,843 A 3/1977 Harada et al.
4,184,700 A 1/1980 Greenaway
(Continued)

FOREIGN PATENT DOCUMENTS

AU 738289 B2 9/2001
AU 2003283372 A1 6/2004
(Continued)

OTHER PUBLICATIONS

European Office Action from EP Application No. 10790829.5, dated Sep. 20, 2016.
(Continued)

*Primary Examiner* — Kyle R Grabowski
(74) *Attorney, Agent, or Firm* — Workman Nydegger

(57) ABSTRACT

A security element (1) for a security paper, value document or the like, having a carrier (8) which has an areal region (3) which is divided into a multiplicity of pixels (4) which respectively includes at least one optically active facet (5), whereby the majority of the pixels (4) respectively have several of the optically active facets (5) of identical orientation per pixel (4), and the facets (5) are so oriented that the areal region (3) is perceptible to a viewer as an area that protrudes and/or recedes relative to its actual spatial form.

27 Claims, 14 Drawing Sheets

(51) Int. Cl.

| | |
|---|---|
| ***B42D 15/00*** | (2006.01) |
| ***B42D 25/26*** | (2014.01) |
| ***B42D 25/24*** | (2014.01) |
| ***B42D 25/23*** | (2014.01) |
| ***B42D 25/21*** | (2014.01) |
| ***B42D 25/373*** | (2014.01) |
| ***B42D 25/29*** | (2014.01) |
| *B42D 25/00* | (2014.01) |

(52) U.S. Cl.

CPC ..... *B42D 25/26* (2014.10); *B42D 25/29* (2014.10); *B42D 25/328* (2014.10); *B42D 25/373* (2014.10); *B42D 25/00* (2014.10); *B42D 25/324* (2014.10); *B42D 2035/20* (2013.01)

(56) References Cited

U.S. PATENT DOCUMENTS

| | | | | |
|---|---|---|---|---|
| 4,484,797 | A | 11/1984 | Knop et al. | |
| 4,568,141 | A | 2/1986 | Antes | |
| 4,838,468 | A | 6/1989 | Lesse | |
| 4,838,648 | A | 6/1989 | Phillips et al. | |
| 4,892,385 | A | 1/1990 | Webster, Jr. et al. | |
| 4,984,824 | A | 1/1991 | Antes et al. | |
| 5,032,003 | A | 7/1991 | Antes | |
| 5,101,184 | A | 3/1992 | Antes | |
| 5,105,306 | A | 4/1992 | Ohala | |
| 5,106,125 | A | 4/1992 | Antes | |
| 5,301,062 | A | 4/1994 | Takahashi et al. | |
| 5,335,113 | A | 8/1994 | Jackson et al. | |
| 5,428,479 | A | 6/1995 | Lee | |
| 5,770,120 | A | 6/1998 | Kamihara et al. | |
| 5,825,547 | A | 10/1998 | Lee | |
| 5,909,313 | A | 6/1999 | Lee | |
| 6,088,161 | A | 7/2000 | Lee | |
| 6,157,487 | A | 12/2000 | Staub et al. | |
| 6,226,127 | B1 | 5/2001 | Dunn et al. | |
| 6,342,969 | B1 | 1/2002 | Lee | |
| 6,474,695 | B1 | 11/2002 | Schneider et al. | |
| 6,870,678 | B2 | 3/2005 | Tompkin et al. | |
| 6,927,885 | B2 | 8/2005 | Staub et al. | |
| 6,975,438 | B2 | 12/2005 | Schilling et al. | |
| 6,987,590 | B2 | 1/2006 | Phillips et al. | |
| 7,106,516 | B2 | 9/2006 | Lotz et al. | |
| 7,215,450 | B2 | 5/2007 | Schilling et al. | |
| 7,281,810 | B2 | 10/2007 | Lee | |
| 7,517,578 | B2 | 4/2009 | Rashka et al. | |
| 7,630,954 | B2 | 12/2009 | Adamczyk et al. | |
| 7,699,350 | B2 | 4/2010 | Heim | |
| 7,719,733 | B2 | 5/2010 | Schilling et al. | |
| 7,738,173 | B2 * | 6/2010 | Schilling ..... | B42D 25/324 359/569 |
| 8,149,511 | B2 | 4/2012 | Kaule et al. | |
| 8,187,771 | B2 | 5/2012 | Staub et al. | |
| 8,400,495 | B2 | 3/2013 | Kaule | |
| 8,534,708 | B2 | 9/2013 | Heim et al. | |
| 8,534,709 | B2 | 9/2013 | Hoffmuller et al. | |
| 8,632,100 | B2 | 1/2014 | Kaule et al. | |
| 9,465,148 | B2 | 10/2016 | Schilling et al. | |
| 2001/0041307 | A1 | 11/2001 | Lee et al. | |
| 2004/0032659 | A1 | 2/2004 | Drinkwater | |
| 2004/0057113 | A1 | 3/2004 | Tompkin | |
| 2005/0068624 | A1 | 3/2005 | Schilling et al. | |
| 2005/0127663 | A1 | 6/2005 | Heim | |
| 2005/0179254 | A1 | 8/2005 | Heim et al. | |
| 2005/0270604 | A1 | 12/2005 | Drinkwater | |
| 2006/0251863 | A1 | 11/2006 | Katschorek et al. | |
| 2007/0183045 | A1 | 8/2007 | Schilling et al. | |
| 2007/0246933 | A1 | 10/2007 | Heim et al. | |
| 2007/0291362 | A1 | 12/2007 | Hill et al. | |
| 2008/0160226 | A1 | 7/2008 | Kaule et al. | |
| 2008/0231976 | A1 | 9/2008 | Commander et al. | |
| 2008/0250954 | A1 | 10/2008 | Depta et al. | |
| 2008/0258456 | A1 * | 10/2008 | Rahm ..... | B42D 25/324 283/85 |
| 2008/0259456 | A1 | 10/2008 | Schilling et al. | |
| 2009/0008923 | A1 | 1/2009 | Kaule et al. | |
| 2009/0091834 | A1 | 4/2009 | Ryzi et al. | |
| 2009/0162756 | A1 | 6/2009 | Staub et al. | |
| 2010/0001508 | A1 | 1/2010 | Tompkin et al. | |
| 2010/0045024 | A1 | 2/2010 | Attner et al. | |
| 2010/0177094 | A1 | 7/2010 | Kaule et al. | |
| 2010/0182221 | A1 | 7/2010 | Kaule et al. | |
| 2010/0194091 | A1 | 8/2010 | Heim et al. | |
| 2010/0194532 | A1 | 8/2010 | Kaule | |
| 2010/0208036 | A1 | 8/2010 | Kaule | |
| 2010/0320742 | A1 | 12/2010 | Hoffmuller et al. | |
| 2011/0012337 | A1 | 1/2011 | Heim | |
| 2014/0307321 | A1 | 10/2014 | Schilling et al. | |

FOREIGN PATENT DOCUMENTS

| | | | | |
|---|---|---|---|---|
| CN | 1193299 | A | 9/1998 | |
| CN | 100534807 | C | 9/2009 | |
| CN | 100567022 | C | 12/2009 | |
| CN | 101610907 | A | 12/2009 | |
| DE | 2555214 | A1 | 6/1977 | |
| DE | 19506880 | A1 | 8/1996 | |
| DE | 10129939 | A1 | 1/2003 | |
| DE | 102004017094 | A1 | 11/2005 | |
| DE | 102005025095 | A1 | 12/2006 | |
| DE | 102005027380 | A1 | 12/2006 | |
| DE | 102005061749 | A1 | 7/2007 | |
| DE | 102006016139 | A1 | 10/2007 | |
| DE | 102007063275 | A1 | 7/2009 | |
| DE | 102008008685 | A1 | 8/2009 | |
| DE | 102008013167 | A1 | 9/2009 | |
| DE | 102008046128 | A1 | 3/2010 | |
| EP | 0105099 | A1 | 4/1984 | |
| EP | 0227423 | A2 | 7/1987 | |
| EP | 0330733 | A1 | 9/1989 | |
| EP | 0330738 | A1 | 9/1989 | |
| EP | 0375833 | A1 | 7/1990 | |
| EP | 0429782 | A1 | 6/1991 | |
| EP | 1547807 | A2 | 6/2005 | |
| EP | 1580020 | A1 | 9/2005 | |
| EP | 1658992 | A1 | 5/2006 | |
| EP | 3059093 | A1 | 8/2016 | |
| JP | S57-208514 | A | 12/1982 | |
| JP | S59-12403 | A | 1/1984 | |
| JP | S60-8802 | A | 1/1985 | |
| JP | 2008-0 80 609 | A | 4/2008 | |
| WO | 9007133 | A1 | 6/1990 | |
| WO | 9008338 | A1 | 7/1990 | |
| WO | WO-9008338 | A1 * | 7/1990 | ..... B42D 25/324 |
| WO | 9103747 | A1 | 3/1991 | |
| WO | 9318419 | A1 | 9/1993 | |
| WO | 9428444 | A1 | 12/1994 | |
| WO | 9716772 | A1 | 5/1997 | |
| WO | 9719821 | A1 | 6/1997 | |
| WO | 9734170 | A2 | 9/1997 | |
| WO | 199808131 | A1 | 2/1998 | |
| WO | 9820382 | A1 | 5/1998 | |
| WO | 9823979 | A1 | 6/1998 | |
| WO | 9853999 | A1 | 12/1998 | |
| WO | 9965699 | A1 | 12/1999 | |
| WO | 0013916 | A1 | 3/2000 | |
| WO | 0180175 | A1 | 10/2001 | |
| WO | 0206858 | A2 | 1/2002 | |
| WO | 03068525 | A1 | 8/2003 | |
| WO | 2005038136 | A1 | 4/2005 | |
| WO | 2005042268 | A1 | 5/2005 | |
| WO | 2006013215 | A1 | 2/2006 | |
| WO | 2006087138 | A1 | 8/2006 | |
| WO | 2006125224 | A2 | 11/2006 | |
| WO | 2007076952 | A2 | 7/2007 | |
| WO | 2008049533 | A2 | 5/2008 | |

(56) References Cited

FOREIGN PATENT DOCUMENTS

| | | | |
|---|---|---|---|
| WO | 2009000527 | A1 | 12/2008 |
| WO | 2009000528 | A1 | 12/2008 |

OTHER PUBLICATIONS

European Search Report from EP Application No. 16000444.6, dated Jul. 18, 2016.
Indian Office Action from Indian Application No. 4229/CHEN/2012, dated Mar. 30, 2017.
Canadian Office Action from Canadian Application No. 2,780,934, dated Oct. 17, 2016.
Kotacka et al., "Synthetic Holography at 500.000 dpi: From Renaissance of Portraits to Holographic Dust," Optical Document Security, Reconnaissance International 2008, Jan. 23-25, 2008, pp. 1-13.
Lee, "Micro Mirror Array Nanostructures for Anti-counterfeiting Applications," Optical Security and Counterfeit Deterrence Techniques V, SPIE vol. 5310, 2004, pp. 350-368.
Lee, "Colourtone Lithography," Microelectronic Engineering 61-61, 2002, pp. 105-111.
Leech et al., "Hot Embossing of Grating-based Optically Variable Images in Thermoplastic Acrylic Lacquer," Journal of Materials Science, Springer Science + Business Media, 2007, 7 Pages.
Leech et al., "Optically Variable Micro-mirror Arrays Fabricated by Graytone Lithography," Microelectronic Engineering, vol. 83, 2006, pp. 351-356.
Leech et al., "Printing Via Hot Embossing of Optically Variable Images in Thermoplastic Acrylic Lacquer," Microelectronic Engineering, vol. 86, 2006, pp. 1961-1965.
Leech et al., "Hot Embossing of Diffractive Optically Variable Images in Biaxially-oriented Polypropylene," Microelectronic Engineering, vol. 84, 2007, pp. 25-30.
Van Renesse, "7.2.5 Volume-Reflection-Holography," Optical Document Security, 2005, pp. 250-252.
Chinese Search report from Application No. CN 2010800625972, dated Apr. 21, 2014.
Australian Opposition Proceeding from Application No. 20100327031, Oct. 17, 2014.
Van Renesse, "Optical Document Security," 2005, pp. 36-40 and 250-252.
German Search Report from DE Application No. DE 10 2009 056 932.4, dated Dec. 4, 2009.
International Search Report from PCT Application No. PCT/EP2010/007369, dated Jun. 7, 2011.
German Search Report from DE Application No. 10 2011 108 242.9, dated Mar. 16, 2012.
International Preliminary Report on Patentability From PCT Application No. PCT/EP2010/007369, dated Jun. 5, 2012.
International Search Report from PCT Application No. PCT/EP2012/003059, dated Oct. 31, 2012.
Fuhse, "Combination of Micro Mirrors and Thin Film Color Shift," 2014 Optical Document Security Conference, Jan. 29-31, 2014, 8 Pages.
International Search Report in PCT/EP2010/007368, dated Jun. 8, 2011.
International Preliminary Report on Patentability in PCT/EP2010/007368, dated Jul. 10, 2012.
German Search Report in 10 2009 056 934.0, dated Dec. 4, 2009.

* cited by examiner

SECURITY ELEMENT, VALUE DOCUMENT COMPRISING SUCH A SECURITY ELEMENT, AND METHOD FOR PRODUCING SUCH A SECURITY ELEMENT

BACKGROUND OF THE INVENTION

A. Field of the Invention

The present invention relates to a security element for a security paper, value document or the like, to a value document having such a security element, and to a method for manufacturing such a security element.

B. Related Art

Objects to be protected are frequently equipped with a security element which permits verification of the authenticity of the object and at the same time serves as protection from unauthorized reproduction.

Objects to be protected are for example security papers, identity documents and value documents (such as e.g. bank notes, chip cards, passports, identification cards, identification cards, shares, investment securities, deeds, vouchers, checks, admission tickets, credit cards, health cards, etc.) as well as product authentication elements, such as e.g. labels, seals, packages, etc.

A technology that is widespread particularly in the field of security elements and gives a three-dimensional appearance to a practically planar foil involves various forms of holography. However, such technologies have some disadvantages for the use of a security feature, in particular on bank notes. On the one hand, the quality of the three-dimensional representation of a hologram depends strongly on the illumination conditions. The representations of holograms are often hardly recognizable in particular in diffuse illumination. Furthermore, holograms have the disadvantage that they are meanwhile present at many places in everyday life and, hence, their special rank as a security feature is vanishing.

SUMMARY OF THE DISCLOSURE

On these premises, the invention is based on the object of avoiding the disadvantages of the prior art and in particular providing a security element for a security paper, value document or the like which achieves a good three-dimensional appearance at the same time as an extremely flat configuration of the security element.

According to the invention this object is achieved by a security element for a security paper, value document or the like, having a carrier which has an areal region which is divided into a multiplicity of pixels which respectively comprise at least one optically active facet, whereby the majority of the pixels respectively have several of the optically active facets of identical orientation per pixel, and the facets are so oriented that the areal region is perceptible to a viewer as an area that protrudes and/or recedes relative to its actual spatial form.

This makes it possible to provide an extremely flat security element, in which e.g. the maximum height of the facets is no greater than 10 μm, but which nevertheless produces a very good three-dimensional impression upon viewing. Hence, it is possible to simulate for the viewer an area of strongly bulged appearance by means of a (macroscopically) planar areal region. It is basically possible to produce arbitrarily shaped three-dimensional configurations of the perceptible area in this manner. There can thus be simulated portraits, objects, motifs or other objects of three-dimensional appearance. The three-dimensional impression here is always relative to the actual spatial form of the areal region. Thus, the areal region can be of flat configuration or also of curved configuration itself. However, there is always obtained a three-dimensional appearance relative to this base area form, so that to a viewer the areal region then does not appear planar or curved in the same way as the areal region itself.

The areal region perceptible as a protruding and/or receding area is understood here to mean in particular that the areal region is perceptible as a continuously bulged area. Thus, the areal region can be perceived e.g. as an area with an apparent bulge that deviates from the curvature or actual spatial form of the areal region. With the security element of the invention there can accordingly be imitated e.g. a bulged surface by simulating the corresponding reflection behavior.

The areal region is in particular a contiguous areal region. However, the areal region can also have gaps or even comprise non-contiguous partial regions. In this manner the areal region can be interlaced with other security features. The other security features may involve e.g. a true-color hologram, so that a viewer can perceive together the true-color hologram and the protruding and/or receding area provided by the areal region of the invention.

The orientation of the facets is chosen in particular such that the areal region is perceptible to a viewer as a non-planar area.

The majority of the pixels which respectively have several of the optically active facets of identical orientation per pixel can be 51% of the pixel number. However, it is also possible that the majority is greater than 60%, 70%, 80% or in particular greater than 90% of the pixel number.

Further, it is also possible that all pixels of the areal region respectively have several of the optically active facets of identical orientation.

The optically active facets can be configured as reflective and/or transmissive facets.

The facets can be formed in a surface of the carrier. Further, it is possible that the facets are formed in the upper side as well as in the underside of the carrier and oppose each other. In this case, the facets are preferably configured as transmissive facets with a refractive effect, whereby the carrier itself is of course also transparent or at least translucent. The dimensions and orientations of the facets are then chosen in particular such that an area is perceptible to a viewer such that it protrudes and/or recedes relative to the actual spatial form of the upper side and/or underside of the carrier.

The carrier can be configured as a layered composite. In this case, the facets can lie on an interface within the layered composite. Thus, the facets can e.g. be embossed into an embossing lacquer located on a carrier foil, subsequently metallized, and embedded in a further lacquer layer (e.g. protective lacquer or adhesive lacquer).

In particular, in the security element of the invention, the facets can be configured as embedded facets.

In particular, the optically active facets are so configured that the pixels have no optically diffractive effect.

The dimensions of the optically active facets can be between 1 μm and 300 μm, preferably between 3 μm and 100 μm and particularly preferably between 5 μm and 30 μm. In particular, a substantially ray-optical reflection behavior or a substantially ray-optical refractive effect is preferably present.

The dimensions of the pixels are so chosen that the area of the pixels is smaller than the area of the areal region by at least one order of magnitude and preferably by at least two orders of magnitude. The area of the areal region and the area of the pixels are understood here to be in particular the respective area upon projection in the direction of the macroscopic surface normal of the areal region to a plane.

In particular, the dimensions of the pixels can be chosen such that the dimensions of the pixels at least in one direction are smaller than the dimensions of the area of the areal region by at least one order of magnitude and preferably by at least two orders of magnitude.

The maximum extension of a pixel is preferably between 5 μm and 5 mm, preferably between 10 μm and 300 μm, particularly preferably between 20 μm and 100 μm. The pixel form and/or the pixel size can vary within the security element, but does not have to.

The grating period of the facets per pixel (the facets can form a periodic or aperiodic grating, e.g. a sawtooth grating) is preferably between 1 μm and 300 μm or between 3 μm and 300 μm, preferably between 3 μm and 100 μm or between 5 μm and 100 μm, particularly preferably between 5 μm and 30 μm or between 10 μm and 30 μm. The grating period is chosen in particular such that at least two facets of identical orientation are contained per pixel and that diffraction effects practically no longer play a part for incident light (e.g. from the wavelength range of 380 nm to 750 nm). Since no, or no practically relevant, diffraction effects occur, the facets can be referred to as achromatic facets, or the pixels as achromatic pixels, which cause a directionally achromatic reflection. The security element thus has an achromatic reflectivity with regard to the grating structure present through the facets of the pixels.

The facets are preferably configured as substantially planar area elements. The chosen formulation according to which the facets are configured as substantially planar area elements takes account of the fact that, for manufacturing reasons, perfectly planar area elements can normally never be manufactured in practice.

The orientation of the facets is determined in particular by their inclination and/or their azimuth angle. The orientation of the facets can of course also be determined by other parameters. In particular, the parameters in question are two mutually orthogonal parameters, such as e.g. the two components of the normal vector of the respective facet.

On the facets there can be formed at least in certain regions a reflective or reflection-enhancing coating (in particular a metallic or high-refractive coating). The reflective or reflection-enhancing coating can be a metallic coating which is vapor-deposited for example. As a coating material there can be employed in particular aluminum, gold, silver, copper, palladium, chromium, nickel and/or tungsten as well as alloys thereof. Alternatively, the reflective or reflection-enhancing coating can be formed by a coating with a material having a high refractive index.

The reflective or reflection-enhancing coating can be configured in particular as a partly transmissive coating.

In a further embodiment, there can be formed on the facets at least in certain regions a color-shifting coating. The color-shifting coating can be configured in particular as a thin-film system or thin-film interference coating. There can be realized here e.g. a layer sequence of metal layer—dielectric layer—metal layer or a layer sequence of three dielectric layers, whereby the refractive index of the middle layer is lower than the refractive index of the two other layers. As a dielectric material there can be employed e.g. ZnS, $SiO_2$, $TiO_2/MgF_2$.

The color-shifting coating can also be configured as an interference filter, thin semi-transparent metal layer with selective transmission through plasma resonance effects, nanoparticles, etc. The color-shifting layer can also be realized in particular as a liquid-crystal layer, diffractive relief structure or subwavelength grating. A thin-film system constructed of reflector, dielectric, absorber (formed on the facets in this order) is also possible.

The thin-film system plus facet can be configured not only as facet/reflector/dielectric/absorber, as described above, but also as facet/absorber/dielectric/reflector. The order depends in particular on which side the security element is to be viewed from. Further, color-shift effects visible on both sides are also possible when the thin-film system plus facet is configured for example as absorber/dielectric/absorber/facet or absorber/dielectric/reflector/dielectric/absorber/facet.

The color-shifting coating can be configured not only as a thin-film system, but also as a liquid-crystal layer (in particular of cholesteric liquid-crystal material).

If a diffusely scattering object is to be simulated, a scattering coating or surface treatment of the facets can be provided. Such a coating or treatment can scatter according to Lambert's cosine law, or there can be a diffuse reflection with an angular distribution deviating from Lambert's cosine law. In particular, scattering with a pronounced preferential direction is of interest here.

Upon the manufacture of the facets by an embossing process, the embossing area of the embossing tool, with which the form of the facets can be embossed into the carrier or into a layer of the carrier, can be provided additionally with a microstructure in order to produce certain effects. For example, the embossing area of the embossing tool can be provided with a rough surface, so that facets with diffuse reflection arise in the end product.

In the security element of the invention, at least two facets can preferably be provided per pixel. There can also be three, four, five or more facets.

In the security element of the invention, the number of facets per pixel can be chosen in particular such that a maximum predetermined facet height is not exceeded. The maximum facet height can amount to for example 20 μm or also 10 μm.

Further, in the security element of the invention, the grating period of the facets can be chosen to be identical for all pixels. It is also possible, however, that individual or several ones of the pixels have different grating periods. Further, it is possible that the grating period varies within a pixel and is thus not constant. Furthermore, there can also be embossed into the grating period a phase information item which serves for encoding further information items. In particular, there can be provided a verification mask having grating structures which have the same periods and azimuth angles as the facets in the security element of the invention. In a partial region of the verification mask the gratings can have the same phase parameter as the security element to be verified, and in other regions a certain phase difference. When the verification mask is placed over the security element, the different regions will then appear with varying lightness or darkness on account of the moire effect. In particular, the verification mask can be provided on the same object to be protected as the security element of the invention.

In the security element of the invention, the areal region can be configured such that it is perceptible to a viewer as an imaginary area. This is understood to mean in particular that the security element of the invention shows a reflection behavior that cannot be produced with a real macroscopically bulged surface. In particular, the imaginary area can be perceptible as a rotating mirror which rotates the visible mirror image e.g. by 90°.

Such an imaginary area and in particular such a rotating mirror is very easy for a viewer to detect and to verify.

In principle, any real bulged reflective or transmissive surface can be modified to an imaginary area by means of the areal region of the security element of the invention. This can be realized e.g. by the azimuth angles of all facets being changed, for example rotated by a certain angle. This makes it possible to achieve interesting effects. For example, if all azimuth angles are rotated to the right by 45°, the areal region is a bulged area apparently illuminated from the top right for a viewer, when illuminated directly from above. If all azimuth angles are rotated by 90°, the light reflexes move upon tilting in a direction perpendicular to the direction that a viewer would expect. This unnatural reflection behavior then for example also makes it no longer possible for a viewer to decide whether the area perceptible as bulged is present toward the front or toward the back (relative to the areal region).

Further, diffraction effects can be suppressed in targeted fashion by an aperiodic grating or the introduction of random phase parameters.

Also, it is possible to provide the orientations of the facets with "noise" (i.e. change them slightly relative to the optimal form for the area to be simulated), in order to simulate for example surfaces of matt appearance. Thus, the areal region not only seems to be protruding and/or receding relative to its actual spatial form, but can also be given an exactly registered positioned texture.

Furthermore, the carrier can have, besides the areal region, a further areal region which is preferably interlaced with the one areal region and in particular configured as a further security feature. Such a configuration can be referred to e.g. as interlacing or as a multi-channel image. The further areal region can be divided, in the same way as the one areal region, into a multiplicity of pixels which respectively comprise at least one optically active facet, whereby the majority of the pixels preferably respectively have several of the optically active facets of identical orientation per pixel, and the facets are so oriented that the further areal region is perceptible to a viewer as an area that is bulged or protrudes and/or recedes relative to its actual spatial form. This makes it possible to realize e.g. two different three-dimensional representations.

By means of the interlacing, the one areal region can be superimposed e.g. with additional exactly registered color information or gray scale information (combination for example with true-color hologram or halftone image e.g. on the basis of sub-wavelength gratings).

Furthermore, there can be hidden or stored in the arrangement of the facets a phase information item as a further security element.

In the security element of the invention, at least one facet can have on its surface a light-scattering microstructure. Several or also all facets can of course also have such a light-scattering microstructure on the facet surface.

For example, the light-scattering microstructure can be configured as a coating. In particular, it is possible to embed the facets and to employ as an embedding material one with which the desired light-scattering microstructure can be realized.

With such a configuration, scattering objects, such as e.g. a marble figure, a gypsum model, etc., can be simulated with the security element of the invention.

The facets can of course also be embedded in a colored material, in order to additionally realize a color effect or simulate a colored object.

In the security element of the invention, the orientations of several facets can be so changed relative to the orientations for producing the protruding and/or receding area that the protruding and/or receding area is still perceptible, but with a surface of matt appearance. Thus, the protruding and/or receding area can also be presented with a matt surface appearance.

The invention also comprises a method for manufacturing a security element for security papers, value documents or the like, wherein the surface of a carrier is so height-modulated in an areal region that the areal region is divided into a multiplicity of pixels respectively having at least one optically active facet, whereby the majority of the pixels respectively have several optically active facets of identical orientation per pixel, and the facets are so oriented that the areal region is perceptible to a viewer of the manufactured security element as an area that protrudes and/or recedes relative to its actual spatial form.

The manufacturing method of the invention can be developed in particular such that the security element of the invention as well as the developments of the security element of the invention can be manufactured.

The manufacturing method can further contain the step of computing the pixels starting out from a surface to be simulated. In this computing step the facets (their dimensions as well as their orientations) are computed for all pixels. On the basis of these data the height modulation of the areal region can then be carried out.

In the manufacturing method of the invention, the step of coating the facets can further be provided. The facets can be provided with a reflective or reflection-enhancing coating. The reflective or reflection-enhancing coating can be a complete mirror coating or also a partly transparent mirror coating.

For producing the height-modulated surface of the carrier there can be employed known microstructuring methods, such as e.g. embossing methods. Thus, for example also using methods known from semiconductor fabrication (photolithography, electron beam lithography, laser beam lithography, etc.) suitable structures in resist materials can be exposed, possibly refined, molded, and employed for fabricating embossing tools. There can be used known methods for embossing in thermoplastic foils or into foils coated with radiation-curing lacquers. The carrier can have several layers which are applied successively and optionally structured, and/or it can be assembled from several parts.

The security element can be configured in particular as a security thread, tear thread, security band, security strip, patch or as a label for application to a security paper, value document or the like. In particular, the security element can span transparent or at least translucent regions or recesses.

The term security paper is understood here to be in particular the not yet circulable precursor to a value document, which can have, besides the security element of the invention, for example also further authentication features (such as e.g. luminescent substances provided within the volume). Value documents are understood here to be, on the one hand, documents manufactured from security papers. On the other hand, value documents can also be other documents and objects that can be provided with the security element of the invention in order for the value documents to have uncopiable authentication features, thereby making it possible to check authenticity and at the same time preventing unwanted copying.

There is further provided an embossing tool having an embossing area with which the form of the facets of a security element of the invention (including its developments) can be embossed into the carrier or into a layer of the carrier.

The embossing area preferably has the inverted form of the surface contour to be embossed, whereby this inverted form is advantageously produced by the formation of corresponding depressions.

Further, the security element of the invention can be used as a master for exposing volume holograms or for purely decorative purposes.

To expose the volume hologram, a photosensitive layer in which the volume hologram is to be formed can be brought, directly or through the intermediary of a transparent optical medium, in contact with the front side of the master and thus with the front side of the security element.

Then the photosensitive layer and the master are exposed with a coherent light beam, thereby causing the volume hologram to be written into the photosensitive layer. The procedure can be identical or similar to the procedure for producing a volume hologram as described in DE 10 2006 016 139 A1. The basic procedure is described for example in paragraphs nos. 70 to 79 on pages 7 and 8 of the stated print in connection with FIGS. 1a, 1b, 2a and 2b. There is hereby incorporated by reference into the present application the total content of DE 10 2006 016 139 A1 with regard to the manufacture of volume holograms.

It is evident that the features mentioned hereinabove and those to be explained hereinafter are usable not only in the stated combinations, but also in other combinations or in isolation, without going beyond the scope of the present invention.

DESCRIPTION OF THE DRAWINGS

Hereinafter the invention will be explained more closely by way of example with reference to the attached drawings, which also disclose features essential to the invention. For more clarity, the figures do without a representation that is true to scale and to proportion. There are shown.

DETAILED DESCRIPTION OF EMBODIMENTS OF THE INVENTION

Figure 1:
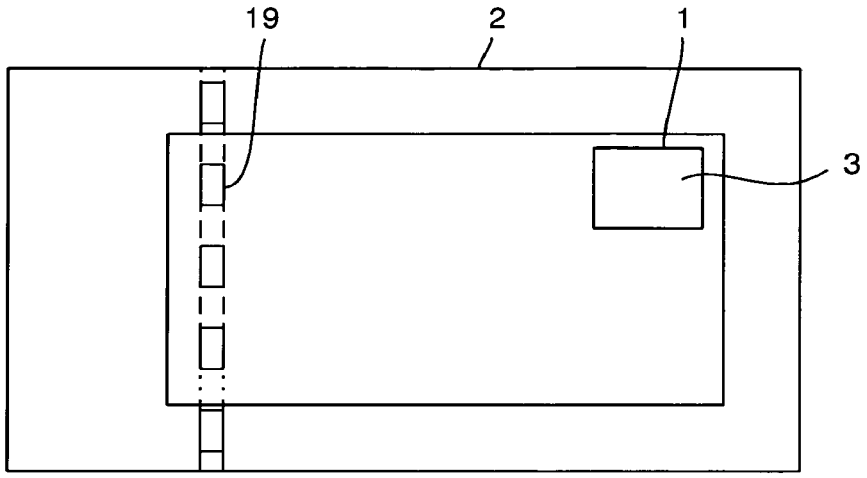
FIG. 1 a plan view of a bank note having a security element 1 according to the invention.

In the embodiment shown in FIG. 1, the security element 1 of the invention is integrated in a bank note 2 such that the security element 1 is visible from the front side of the bank note 2 shown in FIG. 1.

Figure 2:
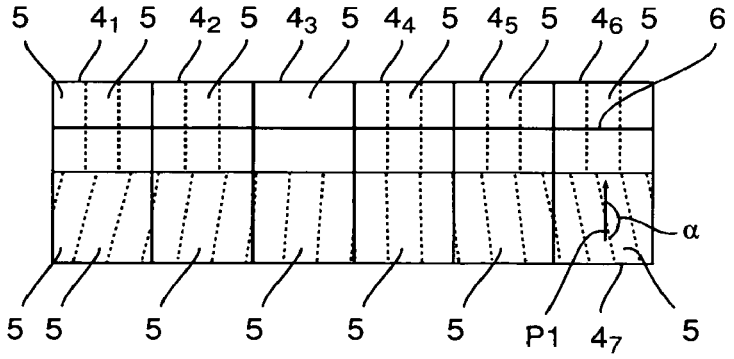
FIG. 2 an enlarged plan view of a part of the area 3 of the security element 1.

The security element 1 is configured as a reflective security element 1 with a rectangular outside contour, whereby the area 3 limited by the rectangular outside contour is divided into a multiplicity of reflective pixels 4 of which a small portion is represented enlarged in FIG. 2 as a plan view.

The pixels 4 here are square and have an edge length in the range of 10 to several 100 μm. Preferably, the edge length is no greater than 300 μm. In particular, it can be in the range between 20 and 100 μm.

The edge length of the pixels 4 is chosen in particular such that the area of each pixel 4 is smaller than the area 3 by at least one order of magnitude, preferably by two orders of magnitude.

The majority of the pixels 4 respectively have several reflective facets 5 of identical orientation, whereby the facets 5 are the optically active areas of a reflective sawtooth grating.

Figure 3:
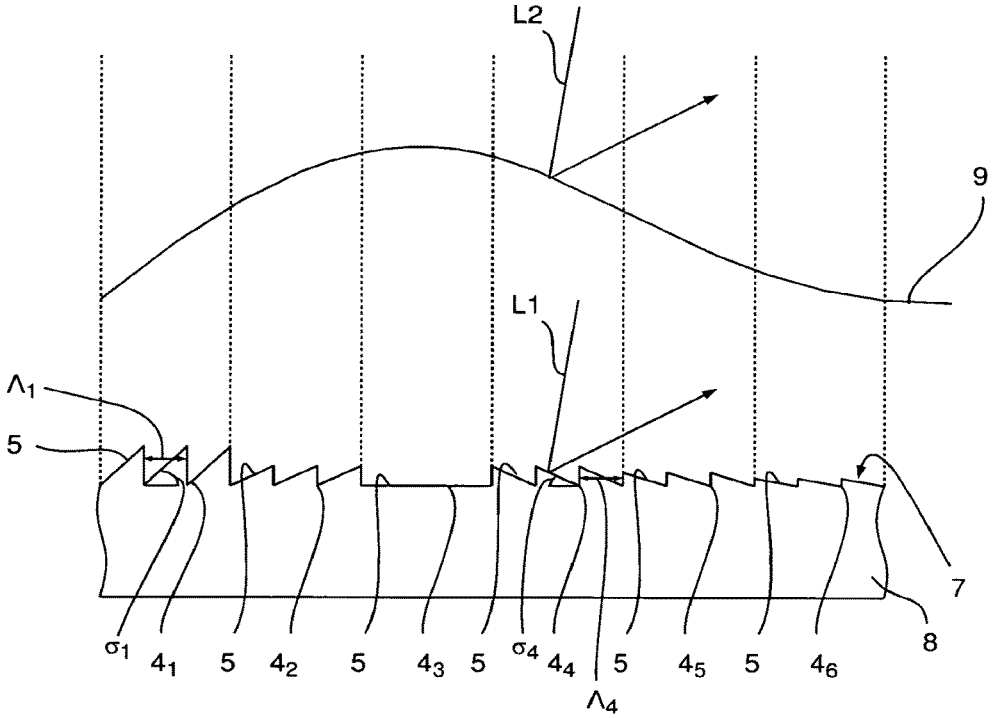
FIG. 3 a cross-sectional view along the line 6 in FIG. 2.
Figure 4:
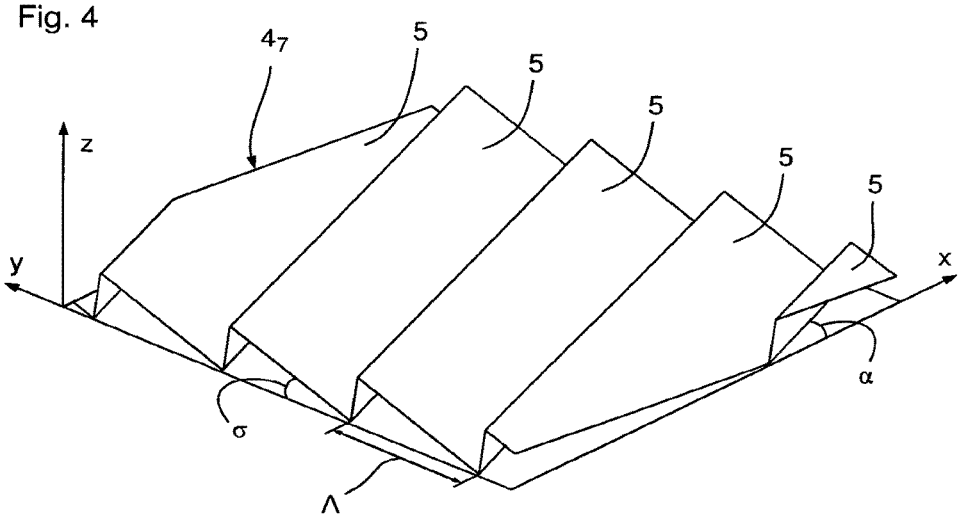
FIG. 4 a schematic perspective representation of the pixel 47 of FIG. 2.

In FIG. 3 there is represented the sectional view along the line 6 for six neighboring pixels $\mathbf{4}_1$, $\mathbf{4}_2$, $\mathbf{4}_3$, $\mathbf{4}_4$, $\mathbf{4}_5$ and $\mathbf{4}_6$, whereby the representation in FIG. 3, as also in the other figures, is partly not true to scale for the sake of better representability. Further, the reflective coating on the facets 5 is not shown in FIGS. 1 to 3 or in FIG. 4 for simplifying the representation.

The sawtooth grating of the pixels 4 is formed here in a surface 7 of a carrier 8, whereby the thus structured surface 7 is preferably coated with a reflective coating (not shown in FIG. 3). The carrier 8 may be for example a radiation-curing plastic (UV resin) which is applied to a carrier foil (for example a PET foil) not shown.

As to be seen in FIG. 3, the pixels $\mathbf{4}_1$, $\mathbf{4}_2$, $\mathbf{4}_4$, $\mathbf{4}_5$ and $\mathbf{4}_6$ respectively have three facets 5 whose orientation is respectively identical per pixel $\mathbf{4}_1$, $\mathbf{4}_2$, $\mathbf{4}_4$, $\mathbf{4}_5$ and $\mathbf{4}_6$. The sawtooth grating and thus also the facets 5 of these pixels are identical here except for their different inclination $\sigma_1$, $\sigma_4$ (for simplifying the representation, only the angles of inclination $\sigma_1$ and $\sigma_4$ of one respective facet 5 of the pixels $\mathbf{4}_1$ and $\mathbf{4}_4$ are drawn in). The pixel $\mathbf{4}_3$ has only a single facet 5 here.

Regarded in plan view (FIG. 2), the facets 5 of the pixels $\mathbf{4}_1$-$\mathbf{4}_6$ are strip-shaped mirror surfaces which are aligned mutually parallel. The orientation of the facets 5 is chosen here such that the area 3 is perceptible to a viewer as an area that protrudes and/or recedes relative to its actual (macroscopic) spatial form, which is the form of a planar area here. A viewer perceives here the surface 9 represented in cross section in FIG. 3 when he looks at the facets 5. This is attained by choosing the orientations of the facets 5, which reflect the incident light L1 as if it were falling on an area according to the spatial form indicated by line 9 in FIG. 3, as represented schematically by the incident light L2. The reflection produced by the facets 5 of a pixel 4 corresponds to the average reflection of the region of the surface 9 that is converted or simulated by the corresponding pixel 4.

In the security element 1 of the invention, a height profile of three-dimensional appearance is thus simulated by a, here gridded, arrangement of reflective sawtooth structures (facets 5 per pixel 4) which imitate the reflection behavior of the height profile. With the area 3 there can thus be produced arbitrary three-dimensionally perceptible motifs, such as e.g. a person, parts of a person, a number or other objects.

Besides the slope $\sigma$ of the individual facets 5, the azimuth angle $\alpha$ of the simulated surface is also to be adjusted. For the pixels $\mathbf{4}_1$-$\mathbf{4}_6$ the azimuth angle $\alpha$ relative to the direction according to the arrow P1 (FIG. 2) amounts to 0°. For the pixel $\mathbf{4}_7$ the azimuth angle $\alpha$ amounts to for example approx. 170°. The sawtooth grating of the pixel $\mathbf{4}_7$ is shown schematically in a three-dimensional representation in FIG. 4.

For manufacturing the security element 1, the reflective sawtooth structures can be written into a photoresist for example by means of gray scale lithography, subsequently developed, electroformed, embossed into UV lacquer (carrier) and mirror-coated. The mirror coating can be realized for example by means of an applied metal layer (for example vapor-deposited). Typically, there is applied an aluminum layer with a thickness of e.g. 50 nm. There can of course also be employed other metals, such as e.g. silver, copper, chromium, iron, etc., or alloys thereof. Alternatively to metals, there can also be applied high-refractive coatings, for example ZnS or $TiO_2$. The vapor deposition can be over the full area. It is also possible, however, to carry out a coating that is only in certain regions or grid-shaped, so that the security element 1 is partly transparent or translucent.

The period $\Lambda$ of the facets 5 is, in the simplest case, identical for all pixels 4. It is also possible, however, to vary the period $\Lambda$ of the facets 5 per pixel 4. Thus, e.g. the pixel $\mathbf{4}_7$ has a smaller period $\Lambda$ than the pixels $\mathbf{4}_1$-$\mathbf{4}_6$ (FIG. 2). In particular, the period $\Lambda$ of the facets 5 can be chosen randomly for each pixel. By varying the choice of the period $\Lambda$ of the sawtooth gratings for the facets 5 it is possible to minimize a possibly existing visibility of a diffraction image arising from the sawtooth gratings.

Within a pixel 4 a fixed period $\Lambda$ is provided. However, it is basically also possible to vary the period $\Lambda$ within a pixel 4, so that aperiodic sawtooth gratings per pixel 4 are present.

For avoiding unwanted diffraction effects, on the one hand, and for minimizing the necessary foil thickness (thickness of the carrier 8), on the other hand, the period $\Lambda$ of the facets 5 is preferably between 3 μm and 300 μm. In particular, the spacing is between 5 μm and 100 μm, whereby particularly preferably a spacing between 10 μm and 30 μm is chosen.

In the embodiment example described here, the pixels 4 are square. It is also possible, however, to configure the pixels 4 to be rectangular. Other pixel forms can also be used, such as e.g. a parallelogrammatic or hexagonal pixel form. The pixels 4 here preferably have dimensions that are greater than the spacing of the facets 5, on the one hand, and are so small that the individual pixels 4 do not disturbingly strike the unarmed eye, on the other hand. The size range resulting from these requirements is between about 10 and a few 100 μm.

Slopes $\sigma$ and azimuth angles $\alpha$ of the facets 5 within a pixel 4 then result from the slope of the simulated height profile 9.

Besides the slope $\sigma$ and the azimuth angle $\alpha$, a phase parameter $p_i$ can further be introduced optionally for each pixel 4. The surface relief of the security element 1 can then be described in the i-th pixel $\mathbf{4}_i$ by the following height function $h_i$ (x,y):

$$h_i(x,y)=A_i[(-x\cdot\sin\alpha_i+y\cdot\cos\alpha_i+p_i)\bmod\Lambda_i]$$

Here, $A_i$ is the amplitude of the sawtooth grating, $\alpha_i$ the azimuth angle, and $\Lambda_i$ the grating period. "mod" stands for the modulo operation and yields the positive remainder upon division. The amplitude factor $A_i$ results from the slope of the simulated surface profile 9.

By changing the phase parameter $p_i$, the sawtooth gratings or the facets 5 of different pixels 4 can be shifted relative to each other. For the parameters $p_i$, random values or other values varying per pixel 4 can be used. There can thus be eliminated a possibly visible diffraction pattern of the sawtooth grating (of the facets 5 per pixel 4) or of the grid grating of the pixels 4, which can otherwise cause unwanted color effects. Further, due to the varied phase parameters $p_i$ there are also no special directions in which the sawtooth gratings of neighboring pixels 4 match each other particularly well or particularly poorly, which prevents a visible anisotropy.

In the security element 1 of the invention, the azimuth angle $\alpha$ as well as the slopes $\sigma$ of the facets 5 per pixel 4 can be chosen such that they do not correspond to the simulated surface 9 as well as possible, but rather deviate therefrom somewhat. For this purpose, a (preferably random) component can be added for each pixel 4 to the optimal value for simulating the surface 9 in accordance with a suitable distribution. Depending on the size of the pixel 4 and the strength of the noise (standard deviation of the distribution), different interesting effects can thus be achieved. In the case of very fine pixels 4 (about 20 μm), the otherwise shiny surface appears increasingly matt with increasing noise. In the case of larger pixels (about 50 μm), one obtains an appearance comparable to a metallic lacquering. In the case of very large pixels (several 100 μm), the individual pixels 4 are resolved by the unarmed eye. They then appear as coarse but smooth portions which light up brightly at different viewing angles.

The strength of the noise can be chosen differently for different pixels 4, through which causes the surface of bulged appearance can seem to vary in smoothness or mattness in different places. There can thus be produced for example the effect that the viewer perceives the area 3 as a smooth protruding and/or receding area having a matt inscription or texture.

Further, it is possible to apply a color-shifting coating, in particular a thin-film system, to the facets 5. The thin-film system can have for example a first, a second and a third dielectric layer which are formed one on the other, whereby the first and third layers have a higher refractive index than the second layer. Due to the different inclinations of the facets 5, different colors are perceptible to a viewer without the security element 1 having to be rotated. The perceptible area thus has a certain color spectrum.

The security element 1 can be configured in particular as a multi-channel image which has different, mutually interlaced partial areas, whereby at least one of the partial areas is configured in the manner according to the invention, so that this partial area is perceptible to the viewer as a three-dimensional partial area. The other partial areas can of course also be configured in the described way by means of pixels 4 with at least one facet 5. The other partial areas can also, but do not have to, be perceptible as an area protruding and/or receding relative to the actual spatial form. The interlacing can be for example of checkered, or also strip-like configuration. Interesting effects are achievable through the interlacing of several partial areas. When e.g. the simulation of a spherical surface is interlaced with the representation of a number, this can be carried out such that for the viewer the impression arises of the number being located in the interior of a glass ball with a semi-mirroring surface.

Besides the above-described employment of color-shifting coatings, it is further possible to provide the security element 1 of the invention additionally with color information. Thus, ink can e.g. be printed on the facets 5 (either transparent or thin) or be provided below an at least partly transparent or translucent sawtooth structure. For example, there can thereby be carried out a decoloration of a motif represented by means of the pixels 4. When e.g. a portrait is simulated, the ink layer can provide the facial color.

A combination with a true-color hologram or Kinegram, in particular the interlacing with a true-color hologram which shows a colored representation of the surface 9 simulated with the pixels 4, is also possible. Thus, the basically achromatic three-dimensional image of an object will appear colored at certain angles.

Further, a combination with a subwavelength grating is possible. In particular, the interlaced representation of the same motif by both technologies is advantageous, whereby the three-dimensional effect of the sawtooth structures is combined with the color information of the subwavelength gratings.

The surface 9 simulated with the pixels 4 may be in particular a so-called imaginary area. This is understood here to be the formation of a reflection behavior or transmission behavior that cannot be produced with a real bulged reflective or transmissive surface.

For further explaining the concept of the imaginary area, a mathematical criterion for delimitation from real areas will hereinafter be introduced and explained by the example of a rotating mirror.

Upon the simulation of a real bulged surface, the latter is describable by a height function h(x,y). It can be assumed here that the function h(x,y) is differentiable (non-differentiable functions could be approximated by differentiable functions that would ultimately produce the same effect for the observer). If one now integrates the gradient of h(x,y) along an arbitrarily closed curve C, the integral will disappear:

$$\oint_C \nabla h(x,y)\,d\vec{s}=0$$

In figurative terms, this means that one walks the same height differences up as down along a closed path and lands at the same height again at the end. The sum of the height differences overcome on this path must thus be zero.

In the security element 1 of the invention, slope and azimuth of the facets 5 correspond to the gradient of the height function. There can now be constructed cases where slope and azimuth of the facets 5 run into each other practically continuously, but no height function can be found with which the above integral disappears. In this case, the simulation of an imaginary area is to be spoken of.

A special embodiment is e.g. a rotating mirror. In this connection, we will first consider the simulation of a real convex mirror with a parabolic profile. The height function is given by $$h(x,y)=-c(x^2+y^2)$$

where c>0 is a constant and determines the curvature of the mirror. In such a mirror the viewer can see an upright reduced mirror image of himself. The parameters of the sawtooth structures are then given by $$\alpha(x,y)=\arctan(x,y)$$

and $$A(x,y)=2c\sqrt{(x^2+y^2)}$$

If one now adds to the azimuth angle α a constant angle δ, the mirror image will be rotated by precisely this angle. Provided that δ does not involve integral multiples of 180°, an imaginary surface will thus arise. If one chooses for example δ=90°, the mirror image will be rotated by 90° and a mirror image obtained that cannot be achieved with a smooth bulged real surface. If one equates the gradient of h to the slope of the sawtooth structures, one can now find closed curves where the above integral does not disappear. For example, a curve K along a circle around the center with radius R>0 yields $$\oint_K \nabla h(x,y)\,d\vec{s}=\oint_K 2c\cdot ds=4\pi cR\neq 0$$

In figurative terms, this rotating mirror thus simulates a surface where one walks continuously uphill along a circle, but lands at the end at the same height at which one started. Such a real surface can obviously not exist.

With the hitherto described security elements 1 it was assumed that the area is configured as a reflective area. However, the same effects of the three-dimensional impression are substantially also achievable in transmission when the sawtooth structures or the pixels 4 with the facets 5 (including the carrier 8) are at least partly transparent. Preferably, the sawtooth structures lie between two layers with different refractive indices. In this case, the security element 1 then appears to the viewer like a glass body with a bulged surface.

The described advantageous embodiments can also be applied for the transmissive configuration of the security element 1. Thus, for example the rotating mirror of an imaginary area can rotate the image in transmission.

The transmissive configuration of the security element will be described in more detail hereinafter in connection with FIGS. 19 to 29.

The forgery resistance of the security element 1 of the invention can be increased by further features only visible with aids, which can also be referred to as hidden features.

Thus, additional information can e.g. be encoded in the phase parameters of the individual pixels 4. In particular, there can be produced a verification mask with grating structures which have the same periods and azimuth angles as the security element 1 of the invention. In a partial region of the area, the gratings of the verification mask can have the same phase parameter as the security element to be verified, and in other regions a certain phase difference. These different regions will then appear to vary in lightness or darkness through moire effects when the security element 1 and the verification mask are placed one over the other.

In particular, the verification mask can also be provided in the bank note 2 or the other element provided with the security element 1.

The pixels 4 can also have other outlines, besides the described outline forms. These outlines can then be recognized with a magnifying glass or a microscope.

Further, an arbitrary other structure can also be embossed or written in a small portion of the pixels 4, instead of the corresponding sawteeth or facets 5, without this striking the unarmed eye. In this case, these pixels are not part of the area 3, so that an interlacing of the area 3 with the differently configured pixels is present. These differently configured pixels can be for example every 100th pixel in comparison to the pixels 4 of the area 3. There can be incorporated into these pixels a microprint or a logo, for example letters that are 10 μm big in a pixel that is 40 μm big.

In the hitherto described embodiment examples, the facets are so formed in the surface 7 of the carrier 8 that the lowest points or the minimum height values of all facets 5 (FIG. 3) lie in a plane. It is also possible, however, to form the facets 5 such that the averages of the heights of all facets 5 are at the same height, as represented schematically in FIG. 5. Further, it is possible to configure the facets 5 such that the peak values or the maximum height values of all facets 5 of the pixels 4 are at the same height, as indicated schematically in FIG. 6.

Figure 7:
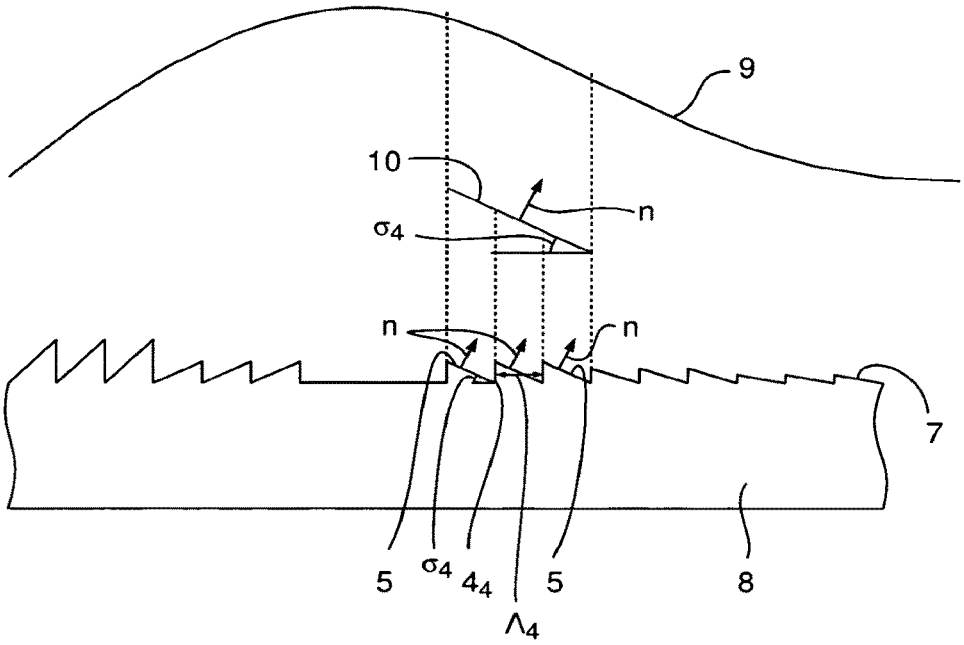
FIG. 7 a sectional view for explaining the computing of the facets.

In FIG. 7 there is shown a sectional representation in the same way as in FIG. 3, but with a mirror surface 10 drawn in for the pixel $\mathbf{4}_4$, which simulates the surface 9 in the region of the pixel $\mathbf{4}_4$. At a pixel size of for example 20 μm to 100 μm, such a mirror surface 10 would result in undesirably great heights d being present. At a mirror inclination of 45°, the corresponding mirror surface 10 would protrude out of the x-y plane by 20 μm to 100 μm. However, maximum heights d of 10 μm are preferably desired. Hence, the mirror surface 10 is subjected to a modulo d operation, so that the facets 5 drawn in FIG. 7 are formed, whereby the normal vectors n of the facets 5 correspond to the normal vector n of the mirror surface 10.

Figure 8:
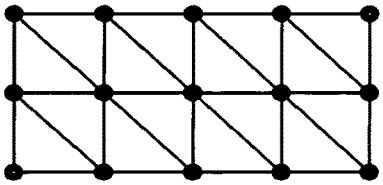
FIG. 8 a plan view for explaining a square grid for computing the pixels.
Figure 9:
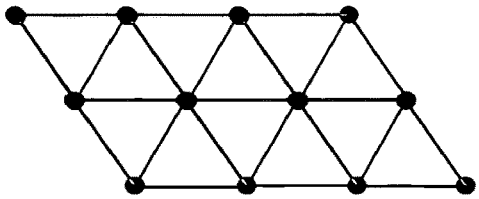
FIG. 9 a plan view for explaining a 60° grid for computing the pixels.

The surface 9 to be simulated can be present for example as a set of x,y values with respectively associated height h in the z direction (3D bitmap). Using such a 3D bitmap, a defined square grid or 60° grid (FIGS. 8, 9) can be constructed in the x-y plane. The grid points are connected so as to result in an area coverage in the x-y plane with triangular tiles, as represented schematically in FIGS. 8 and 9. At the three corner points of each tile the h values are taken from the 3D bitmap. The smallest of these h values is subtracted from the h values of the three corner points of the tiles. With these new h values at the corner points there is constructed a sawtooth area comprising slanted triangles (triangular plane elements). The plane elements protruding too far out of the x-y plane are replaced by the facets 5. This provides the area description for the facets 5 so that the security element 1 of the invention can be manufactured.

The surface 9 to be simulated can be given by a mathematical formula f(x,y,z)=h(x,y)−z=0. The facets 5 or their orientations are obtained from tangent planes of the surface 9 to be simulated. These can be ascertained from the mathematical derivation of the function f(x,y,z). The facet 5 attached at a point $x_0$, $y_0$ is described by the normal vector:

$$\vec{n} = \begin{pmatrix} n_x \\ n_y \\ n_z \end{pmatrix} = \begin{pmatrix} \frac{\partial f}{\partial x}(x_0, y_0, z_0) \\ \frac{\partial f}{\partial y}(x_0, y_0, z_0) \\ \frac{\partial f}{\partial z}(x_0, y_0, z_0) \end{pmatrix} \Big/ \sqrt{\left(\frac{\partial f}{\partial x}(x_0, y_0, z_0)\right)^2 + \left(\frac{\partial f}{\partial y}(x_0, y_0, z_0)\right)^2 + \left(\frac{\partial f}{\partial z}(x_0, y_0, z_0)\right)^2}$$

The azimuth angle α of the tangent plane is arctan $(n_y/n_x)$ and the slope angle σ of the tangent plane is arccos $n_z$. The area f(x,y,z) can be curved arbitrarily and $(x_0,y_0,z_0)$ is the point on the area for which point the computing is being carried out. The computing is carried out successively for all points selected for the sawtooth structure.

Regions are respectively cut out of the slanted planes with the thus computed normal vectors which are to be attached at the selected points in the x-y plane, so that overlaps of the associated elements are avoided in the case of neighboring x-y points. The slanted plane elements protruding too far out of the x-y plane are divided into smaller facets 5, as was described in connection with FIG. 7.

The surface to be simulated can be described by triangular area elements, whereby the planar triangular elements are spanned between selected points which lie within and on the edge of the surface to be simulated. The triangles can be described as plane elements by the following mathematical function f(x,y,z)

$$f(x, y, z) = \begin{vmatrix} x - x_1 & y - y_1 & z - z_1 \\ x_2 - x_1 & y_2 - y_1 & z_2 - z_1 \\ x_3 - x_1 & y_3 - y_1 & z_3 - z_1 \end{vmatrix} = 0,$$

where $x_i$, $y_i$, $z_i$ are the triangular corner points.

In this case, the area can be projected into the x-y plane and the individual triangles slanted according to their normal vector. The slanted plane elements form the facets, and are subdivided into smaller facets 5 if they protrude too far out of the x-y plane, as was described in connection with FIG. 7.

When the surface to be simulated is given by triangular area elements, one can also proceed as follows. The total surface to be simulated is subjected all at once (or cells of each surface) to a Fresnel construction modulo d (or modulo $d_i$). Since the surface to be simulated consists of plane elements, triangles which are filled with the facets 5 automatically arise on the x-y plane.

The construction of the facets can also be carried out as follows. In the x-y plane above which the surface 9 to be simulated is defined, suitable x-y points are chosen and connected so as to yield an area coverage of the x-y plane with polygonal tiles. Above an arbitrarily chosen point (e.g. a corner point) in each tile, the normal vector is determined from the surface 9 thereabove to be simulated. In each tile there is now attached a Fresnel mirror (pixel 4 with several facets 5) corresponding to the normal vector.

Preferably, square tiles or pixels 4 are applied. However, arbitrary (irregular) tilings are possible in principle. The tiles can adjoin each other (which is preferred because of the greater efficiency) or there can be joints between the tiles (for example in the case of circular tiles).

The slope angle σ of the plane can be represented as follows $$\sigma = \arccos n_z = \arccos \frac{\partial f}{\partial z} \Big/ \sqrt{\left(\frac{\partial f}{\partial x}\right)^2 + \left(\frac{\partial f}{\partial y}\right)^2 + \left(\frac{\partial f}{\partial z}\right)^2}$$

The azimuth angle α of the slope can be represented as follows $$\alpha = \arctan(n_y / n_x) = \arctan \frac{\partial f}{\partial y} \Big/ \frac{\partial f}{\partial x}$$

where α=00 to 180° for $n_y$>0 and α=180° to 360° for $n_y$<0.

Determining the facets 5 including their orientations in accordance with the invention can be carried out in two basically different ways. Thus, the x-y plane can be subdivided into pixels 4 (or tiles) and for each pixel 4 the normal vector is determined for the reflective planar area which is then converted to several facets 5 of identical orientation. Alternatively, it is possible to approximate the surface 9 to be simulated by plane elements, if it is not already given by plane elements, and then to subdivide the plane elements into the individual facets 5.

In the first procedure, a tiling in the x-y plane is thus first determined. The tiling can be laid out absolutely arbitrarily. It is also possible, however, that the tiling consists only of identical squares with the side length a, where a is preferably in the range of 10 to 100 μm. The tiling can, however, also consist of different formed tiles which fit together precisely or with which there are joints. The tiles can be formed differently and contain an encoding or an concealed information item. In particular, the tiles can be adjusted to the projection of the surface to be simulated into the x-y plane.

A reference point is then defined in arbitrary fashion in each tile. The normal vectors at the points of the surface to be simulated that lie perpendicularly above the reference points in the tiles are associated with the corresponding tiles. If, in the surface to be simulated lying above the reference point, several normal vectors are associated with the reference point (e.g. at an edge or corner where several area elements abut), an averaged normal vector can be determined from these normal vectors.

A subdivision is defined in each tile in the x-y plane. This subdivision can be arbitrary. From the normal vector the azimuth angle α and the slope angle σ are then computed. Optionally, an offset system can also be defined, which assigns an offset (height value) to each facet 5. The offset can be arbitrary in each region of the subdivision. It is also possible, however, to apply the offset such that the averages of the facets 5 are all at the same height or that the maximum values of all facets 5 are at the same height.

In the subdivisions in the associated tiles there are then attached computationally, as facets 5, slanted plane elements with the normal vector associated with the tile, with consideration of the offset system. The thus computed surface form is then formed in the surface 7 of the carrier 8.

However, there can not only be defined an arbitrary subdivision in each tile in the x-y plane. Thus, there can also be defined, for example, grating lines which are approximately or precisely perpendicular to the projection of the normal vector into the x-y plane. The grating lines can have arbitrary spacings. It is also possible, however, that the spacings of the grating lines follow a certain pattern. Thus, grating lines can be provided for example not precisely parallel to each other, in order to avoid interference for example. It is also possible, however, that the grating lines are parallel to each other but have different spacings. The different spacings of the grating lines can comprise an encoding. Further, it is possible that the grating lines of all facets 5 have equal spacings in each pixel 4. The spacing can be in the range of 1 μm to 20 μm.

The grating lines can also have equal spacings within each tile or within each pixel 4, but vary per pixel 4. The grating line spacing $\Lambda_i$ and the slope angle $\sigma_i$ of the associated facet 5 determine the structure thickness $d_i=\Lambda_i \cdot \tan \sigma_i$, whereby $d_i$ preferably amounts to 1 to 10 μm.

The facets 5 can also all possess the same height d. The grating constant is then determined in a region-based manner by the slope angle $\sigma_i$ of the associated facet i: $\Lambda_i=d/\tan \sigma_i$.

From the normal vector the azimuth angle α and the slope angle σ are then determined again. The sawtooth grating defined by grating lines, azimuth angle and slope angle is attached computationally in the associated tile with consideration of the offset system.

One can also start out from a surface 9 to be simulated that is constructed from plane elements i (or that is so processed that it constructs itself from plane elements i), whereby the structure depth of the surface to be simulated and the dimensions of the plane elements are considerably greater than $d_i$.

For example, the plane elements i are respectively given by three corner points $x_{1i}$, $y_{1i}$, $z_{1i}$; $x_{2i}$, $y_{2i}$, $z_{2i}$; $x_{3i}$, $y_{3i}$, $z_{3i}$.

The relief comprising plane elements is represented by z=f(x,y), where $$(x - x_{1,i}) \cdot \begin{vmatrix} y_{2,i} - y_{1,i} & z_{2,i} - z_{1,i} \\ y_{3,i} - y_{1,i} & z_{3,i} - z_{1,i} \end{vmatrix} - (y - y_{1,i}) \cdot \begin{vmatrix} x_{2,i} - x_{1,i} & z_{2,i} - z_{1,i} \\ x_{3,i} - x_{1,i} & z_{3,i} - z_{1,i} \end{vmatrix} + (z - z_{1,i}) \cdot \begin{vmatrix} x_{2,i} - x_{1,i} & y_{2,i} - y_{1,i} \\ x_{3,i} - x_{1,i} & y_{3,i} - y_{1,i} \end{vmatrix} = 0$$

This yields, solved for z, $$z = z_{1,i} + \frac{(y - y_{1,i}) \cdot \begin{vmatrix} x_{2,i} - x_{1,i} & z_{2,i} - z_{1,i} \\ x_{3,i} - x_{1,i} & z_{3,i} - z_{1,i} \end{vmatrix} - (x - x_{1,i}) \cdot \begin{vmatrix} y_{2,i} - y_{1,i} & z_{2,i} - z_{1,i} \\ y_{3,i} - y_{1,i} & z_{3,i} - z_{1,i} \end{vmatrix}}{\begin{vmatrix} x_{2,i} - x_{1,i} & y_{2,i} - y_{1,i} \\ x_{3,i} - x_{1,i} & y_{3,i} - y_{1,i} \end{vmatrix}}$$

The sought sawtooth area whose structure thickness in the regions i is smaller than $d_i$ results from z modulo $d_i$, where z is computed from the above formula and where the x and y values upon computing respectively lie within the triangle given by $x_{1i}$, $y_{1i}$; $x_{2i}$, $y_{2i}$; $x_{3i}$, $y_{3i}$ in the x-y plane.

The thus computed sawtooth area is automatically composed of the facets 5. There result as grating constants $\Lambda_i$ in the regions i $$\Lambda_i = d_i / \tan \sigma_i$$

If an everywhere equal grating constant $\Delta$ is desired, the following $d_i$ are to be inserted $$d_i = \Lambda \tan \sigma_i$$

where $\sigma_i$ is the slope angle of the triangle given by $x_{1i}$, $y_{1i}$, $z_{1i}$; $x_{2i}$, $y_{2i}$, $z_{2i}$; $x_{3i}$, $y_{3i}$, $z_{3i}$.

The following alternative procedure is possible. In the following formula A a surface 9 to be simulated lying above the x-y plane is described by triangular plane elements $$z = z_{1,i} + \frac{(y - y_{1,i}) \cdot \begin{vmatrix} x_{2,i} - x_{1,i} & z_{2,i} - z_{1,i} \\ x_{3,i} - x_{1,i} & z_{3,i} - z_{1,i} \end{vmatrix} - (x - x_{1,i}) \cdot \begin{vmatrix} y_{2,i} - y_{1,i} & z_{2,i} - z_{1,i} \\ y_{3,i} - y_{1,i} & z_{3,i} - z_{1,i} \end{vmatrix}}{\begin{vmatrix} x_{2,i} - x_{1,i} & y_{2,i} - y_{1,i} \\ x_{3,i} - x_{1,i} & y_{3,i} - y_{1,i} \end{vmatrix}} \quad \text{(A)}$$

The plane elements i are respectively given by three corner points $x_{1i}$, $y_{1i}$, $z_{1i}$; $x_{2i}$, $y_{2i}$, $z_{2i}$; $x_{3i}$, $y_{3i}$, $z_{3i}$.

The corner points are so numbered that $z_{1i}$ is the smallest value among the three values $z_{1i}$, $z_{2i}$, $z_{3i}$ ($z_{1i}$=min ($z_{1i}$, $z_{2i}$, $z_{3i}$)).

The following formula B represents a sawtooth area that simulates the three-dimensional impression of the surface 9 to be simulated given by the formula A $$z = \frac{(y - y_{1,i}) \cdot \begin{vmatrix} x_{2,i} - x_{1,i} & z_{2,i} - z_{1,i} \\ x_{3,i} - x_{1,i} & z_{3,i} - z_{1,i} \end{vmatrix} - (x - x_{1,i}) \cdot \begin{vmatrix} y_{2,i} - y_{1,i} & z_{2,i} - z_{1,i} \\ y_{3,i} - y_{1,i} & z_{3,i} - z_{1,i} \end{vmatrix}}{\begin{vmatrix} x_{2,i} - x_{1,i} & y_{2,i} - y_{1,i} \\ x_{3,i} - x_{1,i} & y_{3,i} - y_{1,i} \end{vmatrix}} \quad \text{(B)}$$

As one can see, the sawtooth area according to formula B differs from the area to be simulated according to formula A in that the minimum value $z_{1i}$ in the region i is respectively subtracted from the value z. The sawtooth area according to formula B consists of slanted triangles attached to the x-y plane.

When a maximum thickness $d_i$ for the structure depth is predetermined, it may be that the maximum thickness is exceeded in the sawtooth area according to formula B. This can be remedied by the formation of the individual facets with an identical normal vector according to z modulo $d_i$, where z is computed from the above formula B and the x and y values upon computing lie respectively within the triangle given by $x_{1i}$, $y_{1i}$; $x_{2i}$, $y_{2i}$; $x_{3i}$, $y_{3i}$ in the x-y plane.

The thus computed sawtooth area is composed of the triangular regions which are filled with the facets 5, whereby the grating constants A in the regions i result as $A_i = d_i / \tan \sigma_i$. The angle $\sigma_i$ is the slope angle of the triangle given by $x_{1i}$, $y_{1i}$, $z_{1i}$; $x_{2i}$, $y_{2i}$, $z_{2i}$; $x_{3i}$, $y_{3i}$, $z_{3i}$.

The procedures shown here for surfaces to be simulated which are described by triangles and which are converted according to the invention into pixels 4 with several facets 5 are to be understood as examples. In general, one proceeds as follows according to the invention in the case of surfaces to be simulated which are described by plane elements. The plane elements are subdivided into cells. Upon the subdivisions a value (for example the minimum value of z in the cell) is subtracted. There is thus obtained according to the invention a sawtooth grating which is flatter than the surface 9 to be simulated and which in region-based fashion has respectively identical normal vectors in the cells.

This sawtooth grating imitates the original surface 9 to be simulated including its three-dimensional impression. This sawtooth grating is flatter than a sawtooth grating created by the same procedure without the subdivision of the pixels 4 into several facets 5 according to the invention.

Figure 10:
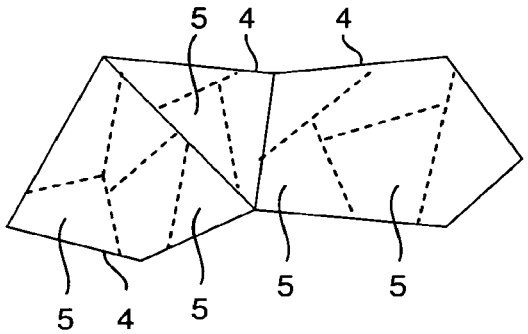
FIG. 10 a plan view of three pixels 4 of the area 3.

In FIG. 10 there is shown a plan view of three pixels 4 of the area 3 according to a further embodiment, whereby the pixels 4 are configured irregularly (continuous lines) with an irregular subdivision or facets 5 (dashed lines). The pixel edges and the subdivisions are straight lines here, but they can also be curved.

Figure 11:
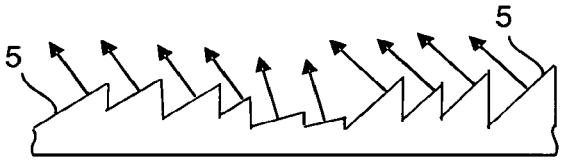
FIG. 11 a cross-sectional view of the representation of FIG. 10.

In FIG. 11 there is shown the corresponding cross-sectional view, whereby the normal vectors of the facets 5 are drawn in schematically. Per pixel 4 the normal vectors of all facets 5 are identical, while they differ from pixel 4 to pixel 4. The normal vectors are slanted in space and generally not in the drawing plane, as represented in FIG. 11 for simplicity's sake.

Figure 12:
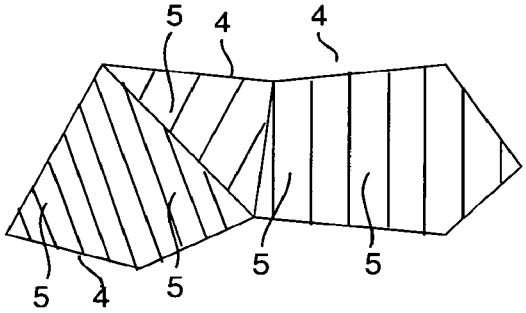
FIG. 12 a plan view of three pixels 4 of the area 3.

In FIG. 12 there is shown a plan view with the same division of the pixels 4 as in FIG. 11, but whereby the subdivision (facets 5) per pixel 4 is different. In the shown embodiment example the grating period $\Lambda$ of the facets 5 is constant in each pixel 4, but different from pixel 4 to pixel 4.

Figure 13:
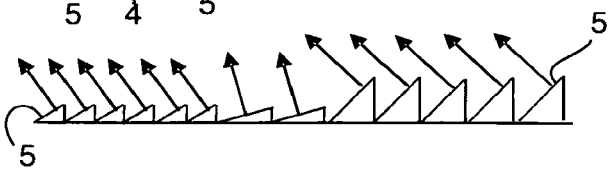
FIG. 13 a cross-sectional view of the plan view of FIG. 12.

FIG. 13 shows the corresponding cross-sectional view.

Figure 14:
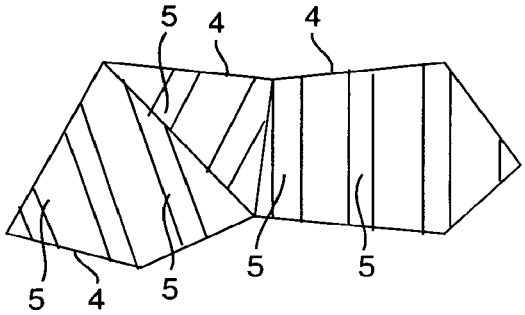
FIG. 14 a plan view of three pixels 4 of the area 3.
Figure 15:
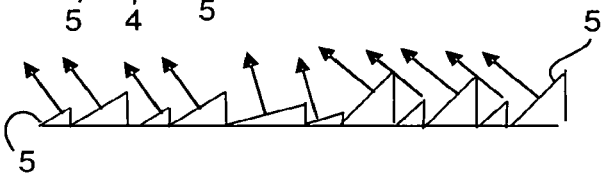
FIG. 15 a sectional view of the plan view of FIG. 14.

In FIG. 14 there is shown a further modification, whereby the pixel form is the same as in FIG. 10. However, the subdivision per pixel 4 is encoded. Every second grating line spacing is twice as large as the preceding grating line spacing. In FIG. 15 the corresponding cross-sectional view is represented.

Figure 16:
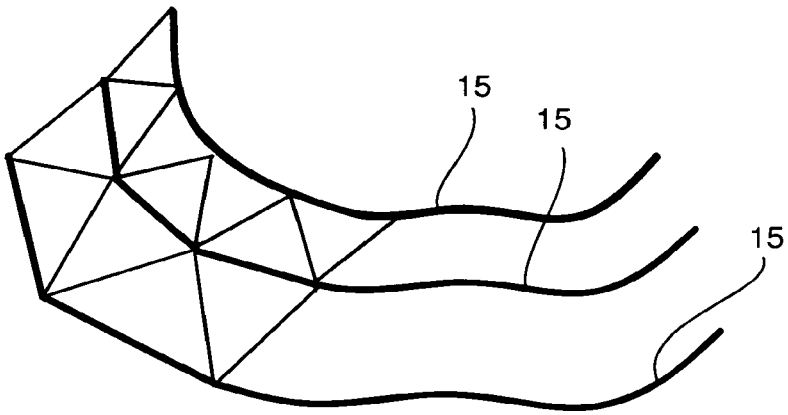
FIG. 16 a plan view for explaining the computing of the pixels according to a further embodiment.
Figure 17:
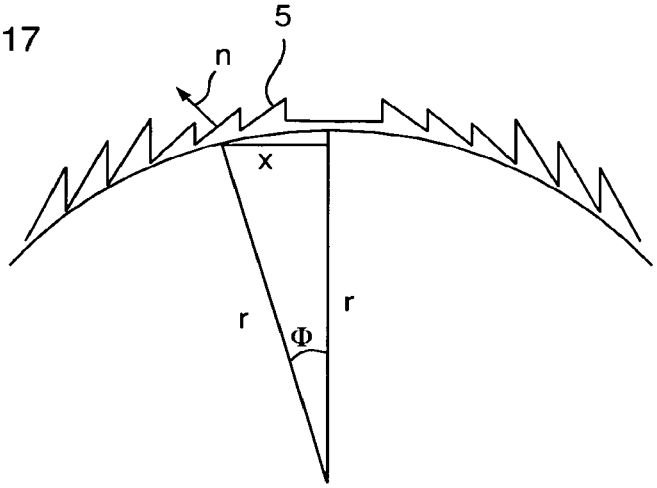
FIG. 17 a sectional view of the arrangement of the facets of the pixels on a cylindrical base area.
Figure 18:
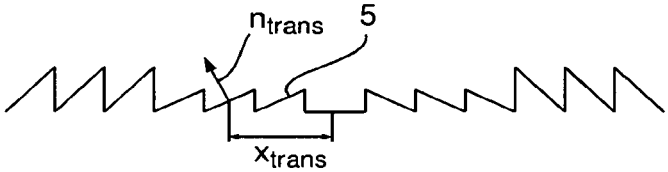
FIG. 18 a sectional view for explaining the production of the pixels for the application according to FIG. 17.
Figure 19:
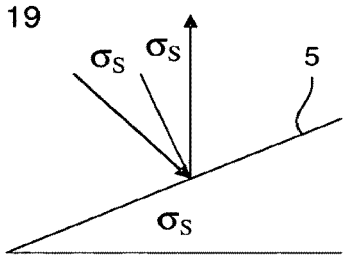
FIGS. 19-21 representations for explaining the angles in reflective and transmissive facets.

If the surface to be simulated is given as a height-line image, the normal vectors can be determined as follows. Discrete points are chosen on the height lines 15 (FIG. 16 shows a schematic plan view) and these points are connected such that a triangular tiling arises. The computing of the normal vector for the triangles is effected in the way described hereinabove.

In the previous embodiments the normal vector was always computed relative to the x-y plane. It is also possible, however, to compute the normal vector in relation to a curved base area, such as e.g. a cylindrical surface. In this case, the security element can be provided on a bottle label (for example on the bottleneck) such that the simulated surface can then be perceived three-dimensionally by a viewer undistorted. For this purpose, the normal vector n relative to the cylindrical surface need only be converted to the normal vector $n_{trans}$ relative to a plane, so that the above-described manufacturing methods can be used. When the security element of the invention is then applied as a bottle label to the bottleneck (with the cylindrical curvature), the simulated surface 9 can then be perceived undistorted in three-dimensional fashion. The conversion to be carried out results from the following formulae $$x=r\sin\Phi,\Phi=\arcsin x/r$$

$$x_{trans}=2\pi r\Phi/360,\Phi=360x_{trans}/2\pi r$$

The normal vector $n_{trans}$ at the place $(x_{trans},y)$ can be computed as follows.

$$\vec{n}_{trans}=\begin{pmatrix}\cos\phi & 0 & \sin\phi\\ 0 & 1 & 0\\ -\sin\phi & 0 & \cos\phi\end{pmatrix}\cdot\vec{n}$$

where $\vec{n}$=normal vector over (x,y).

The security element 1 of the invention can be configured not only as a reflective security element 1, but also as a transmissive security element 1, as mentioned hereinabove. In this case, the facets 5 are not mirror-coated and the carrier 8 consists of a transparent or at least translucent material, whereby the viewing is effected in transmission. Upon an illumination from behind, a user should perceive the simulated surface 9 as if a reflective security element 1 according to the invention illuminated from the front were present.

Figure 20:
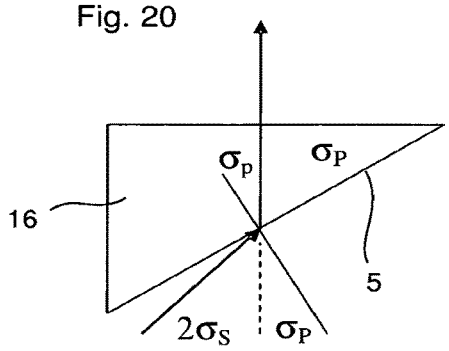
Figure 21:
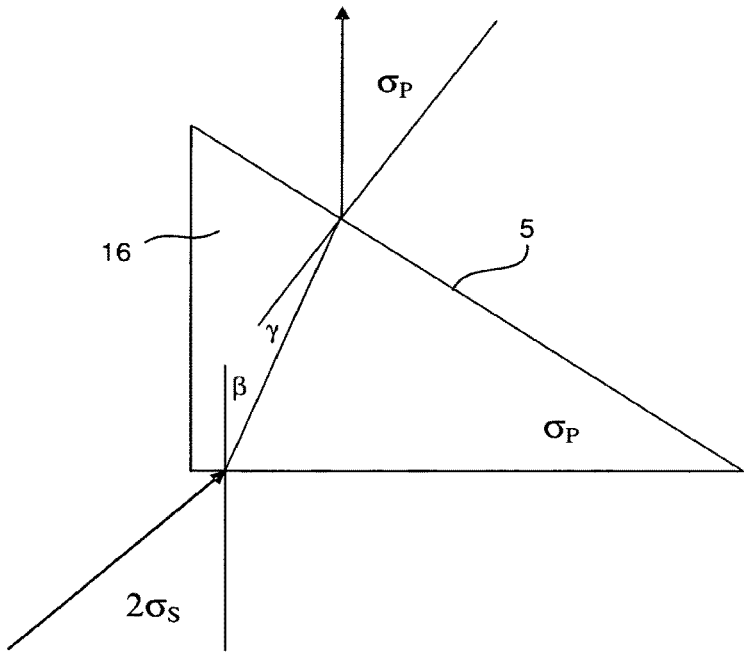

The facets 5 computed for a reflective security element 1 are replaced by data for microprisms 16, whereby the corresponding angles are represented upon reflection (FIG. 19) and for transmissive prisms 16 in FIGS. 20 and 21. FIG. 20 shows the incidence on the inclined facets 5, whereas FIG. 21 shows the incidence on the smooth side, the latter being preferred due to the possible greater incident light angles.

The azimuth angle of the reflective facet 5 is designated $\alpha_s$ and the slope angle of the facet 5 as $\sigma_s$. The refractive index of the microprism 16 amounts to n, the azimuth angle of the microprism 16 amounts to $\alpha_p=180°+\alpha_s$. The slope angle of the microprism 16 according to FIG. 20 amounts to $\sin(\sigma_p+2\sigma_s)=n\sin\sigma_p$, whereby there holds for small angles $2\sigma_s=(n-1)\sigma_p$ and $4\sigma_s=\sigma_p$ (for n=1.5).

The slope angle of the microprism 16 according to FIG. 21 amounts to $\sin(2\sigma_s)=n\sin\beta$; $\sin(\sigma_p)=n\sin(\sigma_p-\beta)$, whereby there holds for small angles $4\sigma_s=\sigma_p$ (for n=1.5).

The components of the normal vector are, when $\alpha$ and $\sigma$ are known, $$n_z=\cos\sigma,n_y/n_x=\sin\alpha/\cos\alpha,n_x^2+n_y^2+n_z^2=1$$

$$n_x=\cos\alpha\cdot\sqrt{1-\cos^2\sigma},n_y=\sin\alpha\cdot\sqrt{1-\cos^2\sigma}$$

Figure 22:
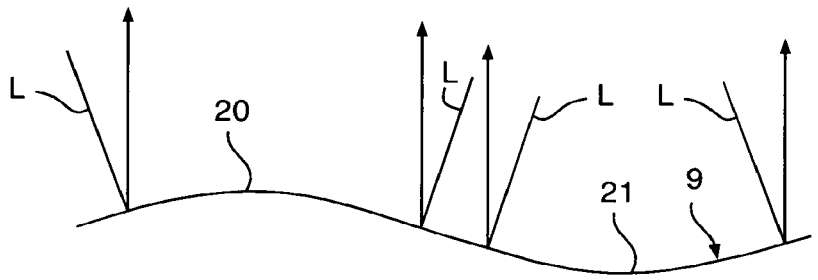
FIG. 22 a sectional view of a reflective surface to be simulated.

In FIG. 22 there is shown schematically a reflective surface 9 to be simulated with a hill 20 and a hollow 21. The negative focal length −f of the mirroring hill 20 amounts to r/2 and the positive focal length f of the mirroring hollow 21 amounts to r/2.

Figure 23:
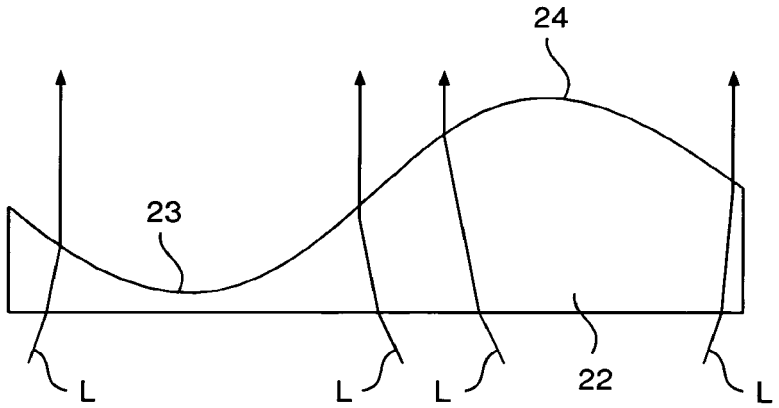
FIG. 23 a sectional view of a lens 22 simulating the surface according to FIG. 22.

In FIG. 23 there is shown schematically a lens 22 which has a transparent concave portion 23 as well as a transparent convex portion 24. The concave portion 23 simulates the mirroring hill 20, whereby the negative focal length −f of the concave portion 23 amounts to 2r. The transparent convex portion 24 simulates the mirroring hollow 21 and has a positive focal length f=2r.

Figure 24:
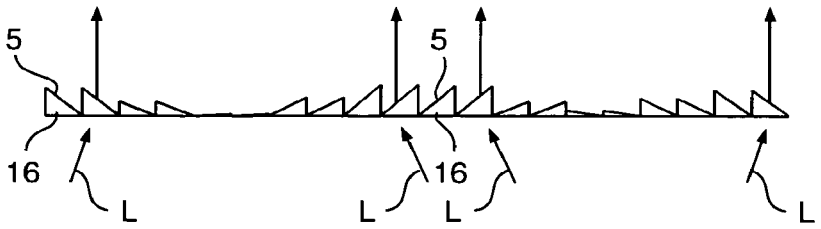
FIG. 24 a sectional view of the transmissive facets for simulating the lens according to FIG. 23.

The lens 22 according to FIG. 23 can be replaced by the sawtooth arrangement according to FIG. 24.

The arrows in FIGS. 20 to 23 show schematically the ray trajectory for incident light L. From these ray trajectories it is evident that the lens 22 simulates the surface 9 in transmission as desired.

Figure 25:
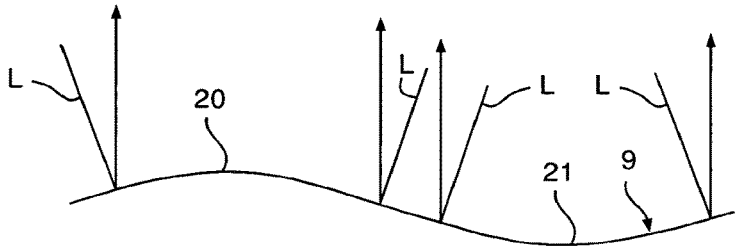
FIG. 25 a sectional view of a reflective surface to be simulated.
Figure 26:
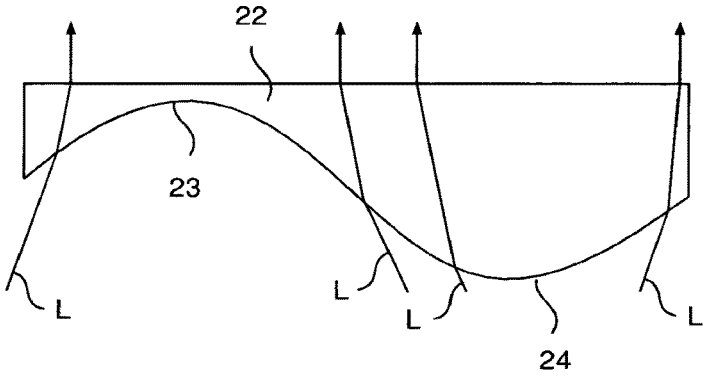
FIG. 26 a sectional view of a lens 22 simulating the surface according to FIG. 25.
Figure 27:
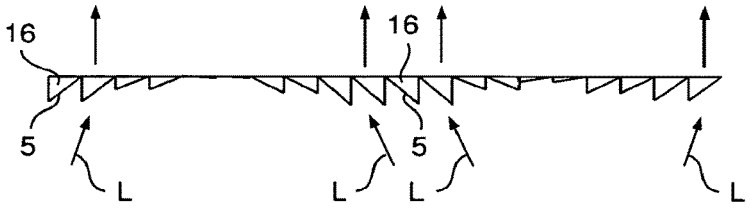
FIG. 27 a sectional view of the corresponding transmissive facets for simulating the lens according to FIG. 24.

In FIGS. 25 to 27 there is shown an example in which the sawtooth side lies on the light incidence side. Otherwise the representation of FIG. 25 corresponds to the representation of FIG. 22, the representation of FIG. 26 corresponds to the representation in FIG. 23, and the representation of FIG. 27 corresponds to the representation in FIG. 24.

For computing the transmissive sawtooth structures the above-described methods can be employed.

The transparent sawtooth structure shown in FIG. 27 corresponds substantially to a cast of a corresponding reflective sawtooth structure for simulating the surface 9 according to FIG. 25. However, the simulated surface here appears substantially flatter in transmission (at a refractive index of 1.5) than in reflection. Hence, the height of the sawtooth structure is preferably increased, or the number of facets 5 per pixel 4 increased.

It is if course also possible to provide the described sawtooth structures with a semi-transparent mirror coating. In this case, the simulated surface 9 normally appears to be more deeply structured in reflection than in transmission.

Figure 28:
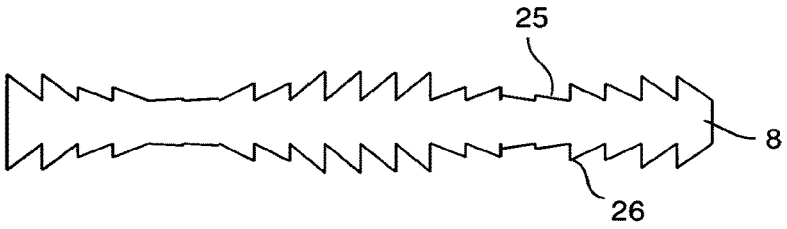
FIG. 28 a sectional view of an embodiment in which transmissive facets are formed on both sides of the carrier 8.
Figure 29:
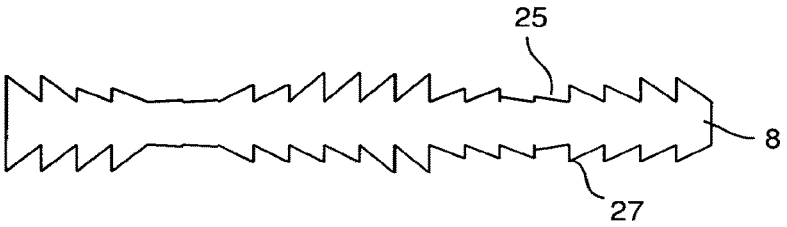
FIG. 29 a sectional view according to a further embodiment in which transmissive facets are formed on both sides of the carrier 8.

Further, it is possible to provide both sides of a transparent or at least translucent carrier 8 with a sawtooth structure which has the multiplicity of microprisms 16, as is indicated in FIGS. 28 and 29. In FIG. 28 the sawtooth structures 25, 26 on both sides are mirror-symmetric. In FIG. 29 the two sawtooth structures 25, 27 are not of mirror-symmetric configuration.

Figure 30:
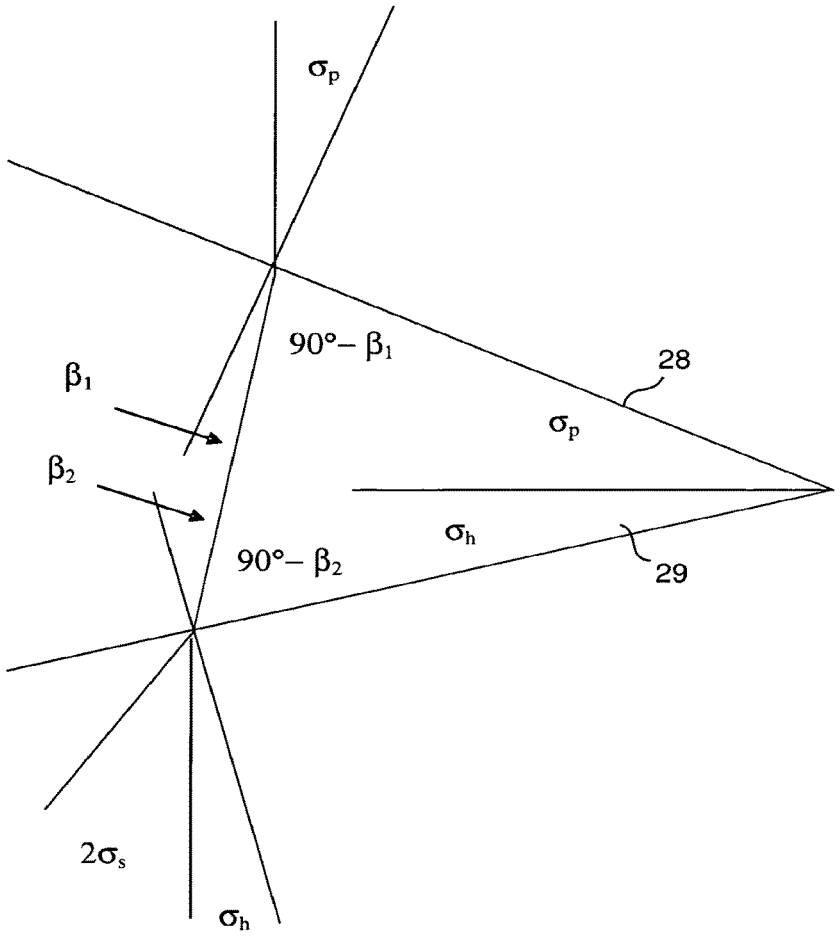
FIG. 30 a representation for explaining the angles in the embodiment in which transmissive facets are formed on both sides of the carrier 8.

For computing a sawtooth structure 25 and 27 according to FIGS. 28 and 29 it can be assumed that the sawtooth structure 25, 27 is composed of a prismatic surface 28 with a slope angle $\sigma_p$ and an auxiliary prism 29 attached thereunder with a slope angle $\sigma_h$, as represented schematically in FIG. 30. Thus, $\sigma_p+\sigma_h$ is the effective total prism angle.

When the relief slope angle to be imitated is designated as $\sigma_s$, the following holds since the angle sum in the triangle is 180°:

$$90°-\beta1+90°-\beta2+\sigma_p+\sigma_h=180°$$

$$\sigma_p+\sigma_h=1+\beta2,$$

From the law of refraction $$\sin\sigma_p=n\sin\beta1,\ \sin(2\sigma_s+\sigma_h)=n\sin\beta2$$

results $$\sigma_p-\arcsin((\sin\sigma_p)/n)=\arcsin((\sin(2\sigma_s+\sigma_h))/n)-\sigma_h$$

Thus, the sought slope angle $\sigma_p$ of the prismatic surface 28 can be easily computed starting out from the relief slope angle $\sigma_s$ to be imitated at an e.g. predetermined auxiliary prism slope angle $\sigma_h$.

It should be noted that a perpendicular viewing has been assumed in the stated computations for the imitation of a mirror relief by prisms. Upon tilted viewing there can result distortions, and upon viewing in white light there can result colored edges on the represented motif, because the refractive index n entering into the computation is wavelength-dependent.

The reflective or refractive security elements represented in FIGS. 1 to 30 can also be embedded into transparent material or provided with a protective layer.

An embedding is effected in particular in order to protect the micro-optic elements from soiling and wear, and in order to prevent unauthorized simulation by taking an impression of the surface structure.

Example: Embedded Mirrors

Figure 32A:
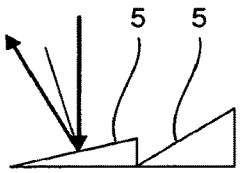
FIGS. 32*a*-32*c* representations for explaining embedded facets, whereby the facets are configured as reflective facets.
Figure 33A:
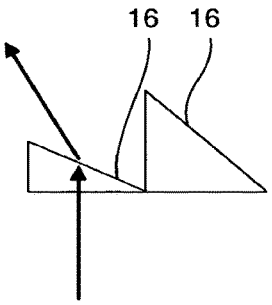
FIGS. 33*a* and 33*b* representations for explaining embedded facets, whereby the facets are configured as transmissive facets.

Upon embedding or attachment of a protective layer, the properties of the micro-optic layer with the facets 5 change. In FIGS. 32 *a-c* this behavior is illustrated for embedded mirrors (the facets 5 are configured as mirrors), whereby FIG. 32*a* shows the arrangement before embedding.

Figure 32B:
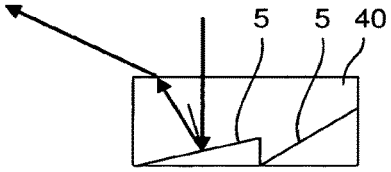
Figure 32C:
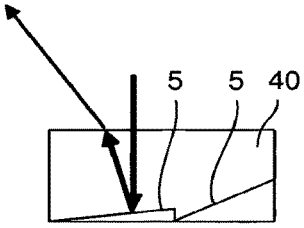

Upon embedding of the mirrors into a transparent layer 40, the direction in which a mirror image appears changes, as FIG. 32*b* shows. If the original reflective effect is now to be achieved in a relief simulated by embedded micromirrors 5, this is to be taken into consideration for the angle of inclination of the micromirrors, see FIG. 32*c*.

Example: Embedded Prisms

With embedded prisms 16, a refractive-index difference between prism material and embedding material 40 is required and to be taken into consideration in the computing of the light beam deflection.

Figure 33B:
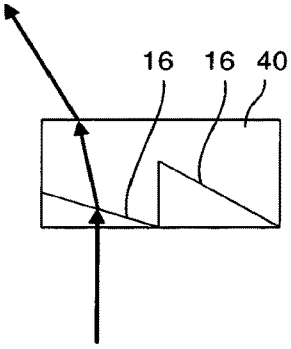

FIG. 33*b* shows schematically the simulation of the reflective arrangement of FIG. 32*a* by a transmissive prism arrangement with open prisms 16, as already discussed e.g. for FIGS. 19-27.

FIG. 33*b* shows schematically a possible simulation of the reflective arrangement of FIG. 32*a* by embedded prisms 16, whereby the refractive indices of prism material and embedding material 40 must differ.

Example: Embedded Scattering Facets

Figure 34:
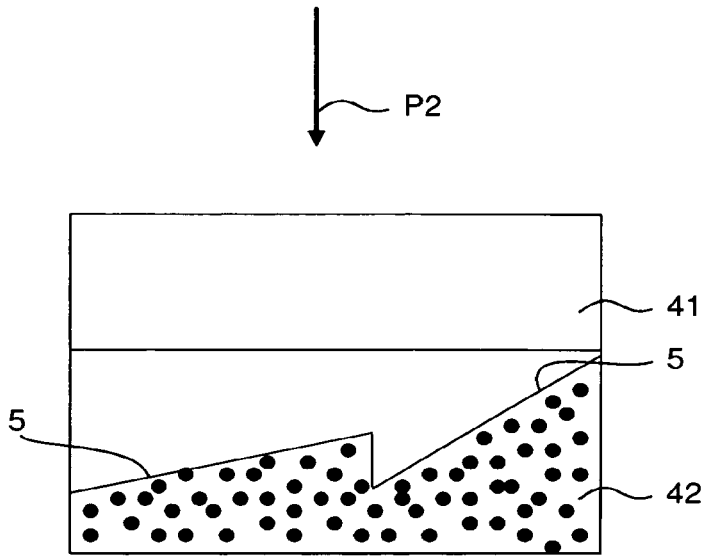
FIG. 34 a representation for explaining embedded scattering facets.

In the two preceding examples the simulation of mirroring objects was demonstrated. For simulating scattering objects (e.g. marble figure, gypsum model), scattering facets can be used, of which here is an example (see FIG. 34):

On a foil 41 as a carrier material the following construction is realized: The embossed facets 5 which simulate the object surface are located on the back side of the foil. The facets 5 have dimensions of for example 10 μm to 20 μm. On the facets 5 there is applied a lacquer 42 pigmented with titanium oxide (particle size approx. 1 μm), so that the facets 5 are filled with this scattering material. The viewing side is indicated by the arrow P2.

Example: Embedded Matt Shining Facets

Figure 35:
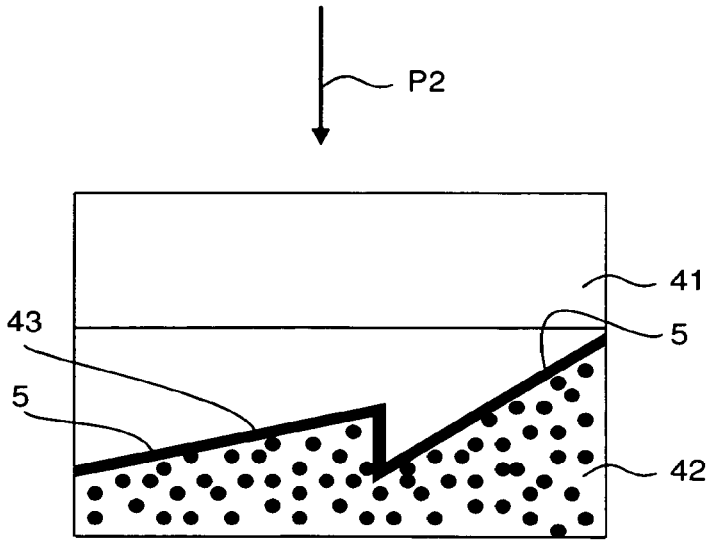
FIG. 35 a representation for explaining embedded matt shining facets.

In the following way a matt reflecting object can be simulated (see FIG. 35):

On a foil 41 as a carrier material the following construction is realized: The embossed facets 5 which simulate the object surface are located on the back side of the foil. The facets 5 have dimensions of for example 10 μm to 20 μm. The embossed layer is provided with a semi-transparent mirror coating 43 and there is applied thereto a lacquer 42 pigmented with titanium oxide (particle size approx. 1 μm), so that the facets are filled with this scattering material. Upon viewing from the viewing side the simulated object appears matt shining. The viewing side is indicated by the arrow P2.

Colored Facets:

For simulating colored objects, the embedding of the facets in FIG. 32*b*, 32*c*, 33*b*, 34 or 35 can be effected with inked material (also material inked differently in various regions).

The security element 1 of the invention can be configured as a security thread 19 (FIG. 1). Further, the security element 1 can not only, as described, be formed on a carrier foil from which it can be transferred to the value document in the known way. It is also possible to form the security element 1 directly on the value document. It is thus possible to carry out a direct printing with subsequent embossing of the security element onto a polymer substrate, in order to form a security element according to the invention on plastic bank notes for example. The security element of the invention can be formed in many different substrates. In particular, it can be formed in or on a paper substrate, a paper with synthetic fibers, i.e. paper with a content x of polymeric material in the range of $0<x<100$ wt %, a plastic foil, e.g. a foil of polyethylene (PE), polyethylene terephthalate (PET), polybutylene terephthalate (PBT), polyethylene naphthalate (PEN), polypropylene (PP) or polyamide (PA), or a multilayer composite, in particular a composite of several different foils (compound composite) or a paper-foil composite (foil/paper/foil or paper/foil/paper), whereby the security element can be provided in or on or between each of the layers of such a multilayer composite.

Figure 5:
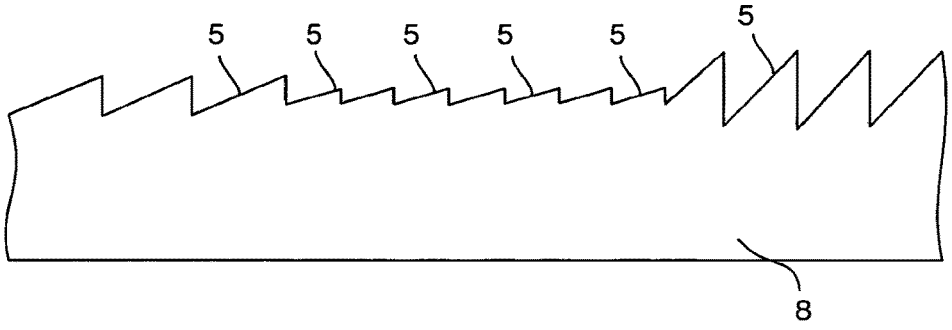
FIG. 5 a sectional view of a further embodiment of some facets of the security element 1.
Figure 6:
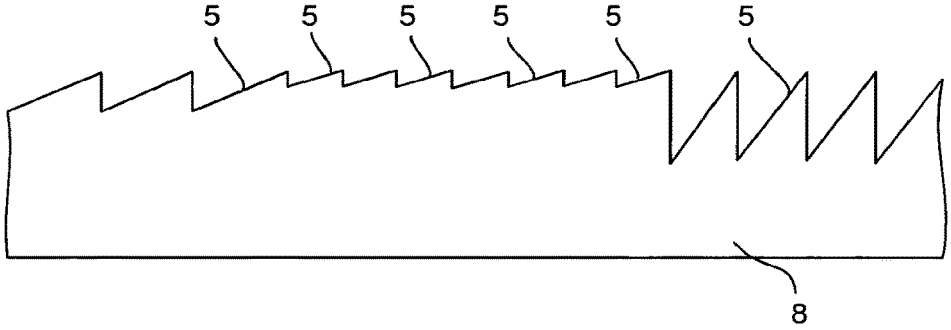
FIG. 6 a sectional view of a further embodiment of some facets of the security element 1.
Figure 31:
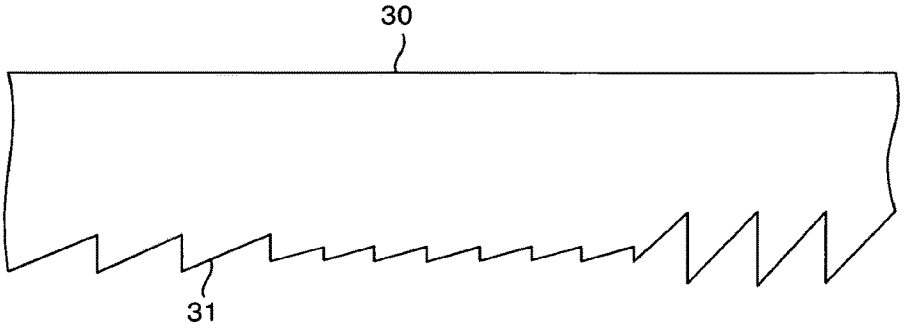
FIG. 31 a schematic sectional view of an embossing tool for manufacturing the security element of the invention according to FIG. 5.

In FIG. 31 there is shown schematically an embossing tool 30 with which the facets 5 can be embossed into the carrier 8 according to FIG. 5. For this purpose, the embossing tool 30 has an embossing area 31 in which the inverted form of the surface structure to be embossed is formed.

A corresponding embossing tool can of course not only be provided for the embodiment according to FIG. 5. An embossing tool of the same kind can also be made available for the other described embodiments.

LIST OF REFERENCE SIGNS

Security element
Bank note
Area
Pixel
Facets
Line
Surface
Carrier
Simulated surface
Mirror surface
15 Height line
16 Microprism
19 Security thread
20 Hill
21 Hollow
22 Lens
23 Concave portion
24 Convex portion
25 Sawtooth structure
26 Sawtooth structure
27 Sawtooth structure
28 Prismatic surface
29 Auxiliary prism
30 Embossing tool
31 Embossing area
40 Transparent layer
41 Foil
42 Pigmented lacquer
43 Semi-transparent mirror coating
L Incident light
L1 Incident light
L2 Incident light
P1 Arrow
P2 Arrow

The invention claimed is:

1. A security element for a security paper, comprising:

a carrier having a first areal region which is divided into a multiplicity of pixels which respectively comprise at least one optically active facet, the majority of said pixels respectively having several optically active facets of identical orientation per pixel, wherein the dimensions of the optically active facets are between 3 μm and 300 μm, and said facets being so oriented that the first areal region is perceptible to a viewer as an area that protrudes and/or recedes relative to its actual spatial form, wherein the carrier includes a second areal region interlaced with the first areal region such that the security element presents a multi-channel image that results in the first areal region being simultaneously perceptible to the viewer together with superimposed additional information provided by the second areal region, wherein the second areal region is configured as a further security feature.

2. The security element according to claim 1, wherein the first areal region and the second areal region are interlaced in a checkered or a strip-like configuration.

3. The security element according to claim 1, wherein the second areal region is divided into a multiplicity of pixels which each respectively comprise at least one optically active facet, wherein the facets of the multiplicity of pixels of the second areal region are so oriented that the second areal region is perceptible to the viewer as a further area that protrudes or recedes relative to its actual spatial form to provide the different images to the viewer.

4. The security element according to claim 3, wherein the facets of the multiplicity of pixels of the second areal region are so oriented that the second areal region is perceptible to the viewer as a further area that protrudes or recedes relative to its actual spatial form to provide two different three-dimensional representations.

5. The security element according to claim 4, wherein each of the two different three-dimensional representations includes one or more of portraits, objects, or motifs of three-dimensional appearance.

6. The security element according to claim 1, wherein the second areal region is configured as one or more of a true-color hologram or a subwavelength grating or a diffractive device representing a two-dimensional kinematic effect.

7. The security element according to claim 1, wherein the first areal region and the second areal region represent the same portrait, object, or motif.

8. The security element according to claim 1, wherein the orientation of the facets is so chosen that at least the first areal region is perceptible to the viewer as a non-planar area.

9. The security element according to claim 1, wherein the optically active facets are configured as reflective facets.

10. The security element according to claim 1, wherein the optically active facets are configured as transmissive facets with a refractive effect.

11. The security element according to claim 1, wherein the optically active facets are so configured that the pixels have no optically diffractive effect.

12. The security element according to claim 1, wherein the area of each pixel is smaller than the area of the areal region by at least one order of magnitude.

13. The security element according to claim 1, wherein the facets are formed in a surface of the carrier.

14. The security element according to claim 1, wherein the facets are configured as embedded facets.

15. The security element according to claim 1, wherein the facets are configured as substantially planar area elements.

16. The security element according to claim 1, wherein the orientation of the facets is determined by their inclination and/or their azimuth angle.

17. The security element according to claim 1, wherein the facets form a periodic or aperiodic grating, and the grating period of the facets is between 1 μm and 300 μm.

18. The security element according to claim 1, wherein a phase parameter pi is introduced for each pixel, wherein the phase parameter pi varies such that gratings of different pixels, said grating formed by the facets or the facets of different pixels, are shifted relative to each other, wherein for the parameter pi, random values or other values varying per pixel are used.

19. The security element according to claim 1, wherein there is formed on the facets at least in certain regions a reflective coating or a reflection-enhancing coating.

20. The security element according to claim 1, wherein there is formed on the facets at least in certain regions a color-shifting coating.

21. The security element according to claim 1, wherein the maximum extension of a pixel is between 5 μm and 5 mm.

22. The security element according to claim 1, wherein the first areal region is perceptible to a viewer as an imaginary area with a reflection behavior or a transmission behavior that cannot be produced with a real bulged reflective surface or a real bulged transmissive surface, and the areal region is perceptible as a rotating mirror.

23. The security element according to claim 1, wherein the orientations of several facets are so changed relative to the orientations for producing the protruding and/or receding area that the protruding and/or receding area is still perceptible but with a surface of matt appearance.

24. The security element according to claim 1, wherein the orientations of several facets vary relative to the orientations so as to produce the protruding and/or receding area that is perceptible but with a surface of matt appearance.

25. A value document comprising the security element recited in claim 1.

26. A method for making a security element for security papers comprising the steps:

forming a surface of a carrier to be height-modulated in a first areal region such that the first areal region is divided into a multiplicity of pixels respectively having at least one optically active facet, wherein the majority of the pixels respectively are formed to have several optically active facets of identical orientation per pixel, wherein the dimensions of the optically active facets are between 3 μm and 300 μm, and said facets are formed to be so oriented that the first areal region is perceptible to a viewer of the security element as an area that protrudes and/or recedes relative to its actual spatial form, wherein forming the surface of the carrier includes forming the carrier to include a second areal region interlaced with the first areal region such that the security element is formed to present a multi-channel image that results in the first areal region being simultaneously perceptible to the viewer together with superimposed additional information provided by the second areal region, wherein the second areal region is configured as a further security feature.

27. An embossing tool comprising an embossing area capable of embossing the form of the facets of a security element recited in claim 1.

* * * * *